US011588253B2

(12) United States Patent
Shin et al.

(10) Patent No.: US 11,588,253 B2
(45) Date of Patent: Feb. 21, 2023

(54) ANTENNA INCLUDING CONDUCTIVE PATTERN AND ELECTRONIC DEVICE INCLUDING ANTENNA

(71) Applicant: Samsung Electronics Co., Ltd., Suwon-si (KR)

(72) Inventors: Donghun Shin, Suwon-si (KR); Mincheol Seo, Suwon-si (KR); Hosaeng Kim, Suwon-si (KR); Yoonjae Lee, Suwon-si (KR); Byungman Lim, Suwon-si (KR); Jaebong Chun, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/748,670

(22) Filed: May 19, 2022

(65) Prior Publication Data

US 2022/0285854 A1 Sep. 8, 2022

Related U.S. Application Data

(63) Continuation of application No. 17/397,113, filed on Aug. 9, 2021, now Pat. No. 11,367,966, which is a (Continued)

(30) Foreign Application Priority Data

Feb. 19, 2019 (KR) ..... 10-2019-0019113

(51) Int. Cl.
*H01Q 9/44* (2006.01)
*H01Q 21/06* (2006.01)
(Continued)

(52) U.S. Cl.
CPC ..... *H01Q 21/062* (2013.01); *H01Q 1/38* (2013.01); *H01Q 21/065* (2013.01); *H01Q 1/24* (2013.01);
(Continued)

(58) Field of Classification Search
CPC ..... H01Q 21/062; H01Q 1/38; H01Q 21/065; H01Q 1/243; H01Q 21/28
See application file for complete search history.

(56) References Cited

U.S. PATENT DOCUMENTS 7,119,748 B2 10/2006 Autti
7,623,073 B2 11/2009 Teshirogi et al.
(Continued)

FOREIGN PATENT DOCUMENTS

CN 101103491 A 1/2008
CN 102823062 A 12/2012
(Continued)

OTHER PUBLICATIONS

Extended European Search Report dated Jun. 30, 2020, issued in European Patent Application No. 20158178.2.
(Continued)

*Primary Examiner* — Joseph J Lauture
(74) *Attorney, Agent, or Firm* — Jefferson IP Law, LLP

(57) ABSTRACT

An electronic device including an antenna and a conductive pattern formed around the antenna is provided. The electronic device includes a housing including a first plate, a second plate facing away from the first plate, and a side member surrounding a space between the first plate and the second plate, connected to the second plate or integrally formed with the second plate, and including a conductive material, an injection-molding material disposed in the space between the first plate and the second plate in the housing and formed of a non-conductive material, an
(Continued)

antenna module including conductive radiators and supported by the injection-molding material, and a conductive pattern disposed on a first surface adjacent to the second plate of the injection-molding material or disposed inside the injection-molding material and disposed adjacent to a part of an edge of the antenna module corresponding to a boundary between the antenna module and the injection-molding material when viewed from the second plate in a direction of the first plate. A partial conductive radiator of the conductive radiators may be disposed to transmit and/or receive a signal through the second plate.

10 Claims, 18 Drawing Sheets

Related U.S. Application Data continuation of application No. 16/794,883, filed on Feb. 19, 2020, now Pat. No. 11,152,716.

(51) Int. Cl.

| | |
|---|---|
| ***H01Q 1/38*** | (2006.01) |
| *H01Q 1/24* | (2006.01) |
| *H01Q 13/18* | (2006.01) |
| *H01Q 21/28* | (2006.01) |

(52) U.S. Cl.

CPC ..... *H01Q 1/243* (2013.01); *H01Q 13/18* (2013.01); *H01Q 21/064* (2013.01); *H01Q 21/28* (2013.01)

(56) References Cited

U.S. PATENT DOCUMENTS

| | | | |
|---|---|---|---|
| 7,639,183 | B2 | 12/2009 | Teshirogi et al. |
| 8,981,998 | B2 | 3/2015 | Orime et al. |
| 10,490,879 | B2 | 11/2019 | Baek et al. |
| 10,608,336 | B2 | 3/2020 | Chen et al. |
| 10,819,002 | B2 | 10/2020 | Zhu et al. |
| 11,081,807 | B2 | 8/2021 | Jong et al. |
| 2008/0231541 | A1 | 9/2008 | Teshirogi et al. |
| 2013/0027269 | A1 | 1/2013 | Orime et al. |
| 2015/0145732 | A1 | 5/2015 | Minemura et al. |
| 2015/0148096 | A1 | 5/2015 | Chae et al. |
| 2016/0018856 | A1 | 1/2016 | Heo et al. |
| 2016/0336646 | A1 | 11/2016 | Baek et al. |
| 2017/0365920 | A1 | 12/2017 | Mukai et al. |
| 2018/0212310 | A1 | 7/2018 | Tsai et al. |
| 2018/0226366 | A1 | 8/2018 | Kim et al. |
| 2018/0233817 | A1 | 8/2018 | Izawa |
| 2018/0254563 | A1 | 9/2018 | Sonozaki et al. |
| 2018/0366818 | A1 | 12/2018 | Kawaguchi et al. |
| 2019/0006751 | A1 | 1/2019 | Chen et al. |
| 2019/0020100 | A1 | 1/2019 | Jong et al. |
| 2019/0027807 | A1 | 1/2019 | Choi et al. |
| 2019/0198995 | A1 | 6/2019 | Ryoo et al. |
| 2020/0106167 | A1 | 4/2020 | Moon et al. |
| 2020/0112100 | A1 | 4/2020 | Ryoo et al. |
| 2020/0203804 | A1 | 6/2020 | Khripkov et al. |
| 2020/0227823 | A1 | 7/2020 | Chen et al. |
| 2020/0259243 | A1 | 8/2020 | Jeon et al. |
| 2021/0143536 | A1* | 5/2021 | Park ..... H01Q 1/2283 |

FOREIGN PATENT DOCUMENTS

| | | | |
|---|---|---|---|
| CN | 107646156 | A | 1/2018 |
| CN | 107658556 | A | 2/2018 |
| CN | 108352621 | A | 7/2018 |
| CN | 108389855 | A | 8/2018 |
| CN | 108604736 | A | 9/2018 |
| CN | 109088180 | A | 12/2018 |
| CN | 109256612 | A | 1/2019 |
| KR | 10-1467321 | B1 | 12/2014 |
| KR | 10-1939047 | B1 | 1/2019 |
| KR | 10-2020-0038034 | A | 4/2020 |
| WO | 2006/070233 | A1 | 7/2006 |
| WO | 2018/206116 | A1 | 11/2018 |
| WO | 2019/004750 | A1 | 1/2019 |
| WO | 2020/166812 | A1 | 8/2020 |

OTHER PUBLICATIONS

International Search Report dated Jun. 12, 2020, issued in International Patent Application No. PCT/KR2020/002371.

Chinese Office Action dated Dec. 22, 2020, issued in Chinese Application No. 202010101982.9.

European Search Report dated Nov. 25, 2020, issued in European Application No. 20158178.2.

Chinese Office Action dated Aug. 16, 2021, issued in Chinese Patent Application No. 202010101982.9.

Australian Office Action dated Nov. 10, 2022, issued in Australian Patent Application No. 2021261851.

* cited by examiner

ANTENNA INCLUDING CONDUCTIVE PATTERN AND ELECTRONIC DEVICE INCLUDING ANTENNA

CROSS-REFERENCE TO RELATED APPLICATION(S)

This application is a continuation application of prior application Ser. No. 17/397,113, filed on Aug. 9, 2021, which application is a continuation application of prior application Ser. No. 16/794,883, filed on Feb. 19, 2020, which has issued as U.S. Pat. No. 11,152,716 on Oct. 19, 2021 and is based on and claims priority under 35 U.S.C. § 119(a) of a Korean patent application number 10-2019-0019113, filed on Feb. 19, 2019, in the Korean Intellectual Property Office, the disclosure of which is incorporated by reference herein in its entirety.

BACKGROUND

1. Field

The disclosure relates to a technology for implementing an electronic device including an antenna and a conductive pattern formed around the antenna.

2. Description of Related Art

With the development of communication technologies, an electronic device equipped with an antenna is being widely supplied. The electronic device may transmit/receive a voice signal and a radio frequency (RF) signal including data (e.g., a message, a photo, a video, a music file, or a game), using the antenna. The electronic device may perform communication, using a high frequency (e.g., 5th generation (5G) communication or millimeter wave). When high frequency communication is performed, an array antenna may be applied to overcome high transmission loss.

The above information is presented as background information only to assist with an understanding of the disclosure. No determination has been made, and no assertion is made, as to whether any of the above might be applicable as prior art with regard to the disclosure.

SUMMARY

In the meantime, nowadays, an antenna module in which an antenna and a radio frequency integrated circuit are combined may be disposed in an electronic device.

The antenna module of the electronic device may be mounted on the injection-molding material made of a non-conductive material. The signal radiated by the antenna module may be radiated to the outside of the electronic device through at least part of the housing of the electronic device. At this time, a surface wave may be generated along the injection-molding material in the antenna module. When the signal is radiated from the injection-molding material by the surface wave, the signal radiated by the antenna module may be distorted.

Furthermore, in at least part of the housing of an electronic device, for example, the surface of the rear cover, some signals may be reflected into the electronic device, and thus the multiple reflection may occur. When the signal is reflected from the injection-molding material by the multiple reflection, the signal radiated by the antenna module may be distorted.

Aspects of the disclosure are to address at least the above-mentioned problems and/or disadvantages and to provide at least the advantages described below. Accordingly, an aspect of the disclosure is to provide an electronic device that prevents the distortion of the signal radiated by the antenna module and increases the gain of the signal radiated to the outside of the electronic device, by forming a conductive pattern for preventing surface waves and the multiple reflection that occur upon mounting the antenna module.

Additional aspects will be set forth in part in the description which follows and, in part, will be apparent from the description, or may be learned by practice of the presented embodiments.

In accordance with an aspect of the disclosure, an electronic device is provided. The electronic device includes a housing including a first plate, a second plate facing away from the first plate, and a side member surrounding a space between the first plate and the second plate, connected to the second plate or integrally formed with the second plate, and including a conductive material, an injection-molding material disposed in the space between the first plate and the second plate in the housing and formed of a non-conductive material, an antenna module including a plurality of conductive radiators and supported by the injection-molding material, and a conductive pattern disposed on a first surface adjacent to the second plate of the injection-molding material or disposed inside the injection-molding material and disposed adjacent to at least a part of an edge of the antenna module corresponding to a boundary between the antenna module and the injection-molding material when viewed from the second plate in a direction of the first plate. At least a partial conductive radiator of the plurality of conductive radiators may be disposed to transmit and/or receive a signal through the second plate.

In accordance with another aspect of the disclosure, an electronic device is provided. The electronic device may include a housing including a first plate, a second plate facing away from the first plate, and a side member surrounding a space between the first plate and the second plate, connected to the second plate or integrally formed with the second plate, and including a conductive material, an injection-molding material disposed in the space between the first plate and the second plate in the housing and formed of a non-conductive material, an antenna module including a plurality of conductive radiators and supported by the injection-molding material, and conductive patterns disposed on a first surface adjacent to the second plate of the injection-molding material or disposed inside the injection-molding material and disposed adjacent to at least part of an edge of the antenna module corresponding to a boundary between the antenna module and the injection-molding material when viewed from the second plate in a direction of the first plate. At least a partial conductive radiator of the plurality of conductive radiators may be disposed to transmit and/or receive a signal through the second plate. The plurality of conductive patterns may include at least one first conductive pattern configured to transmit or receive a signal of less than 6 GHz. Each of the plurality of conductive patterns may be spaced from one another.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
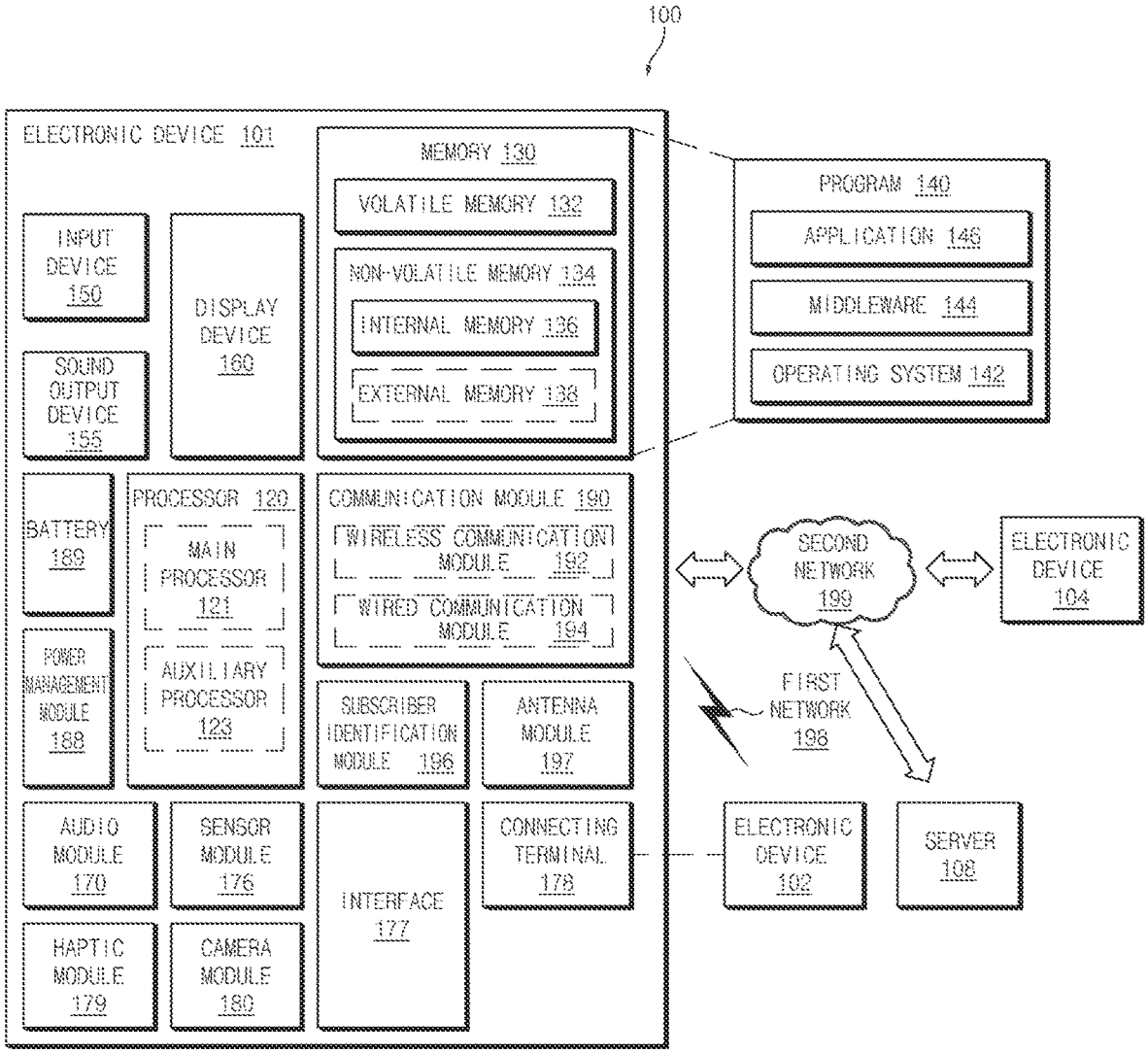
FIG. 1 is a block diagram illustrating an electronic device in a network environment according to an embodiment of the disclosure.

FIG. 1 is a block diagram illustrating an electronic device 101 in a network environment 100 according to an embodiment of the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., printed circuit board (PCB)). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2:
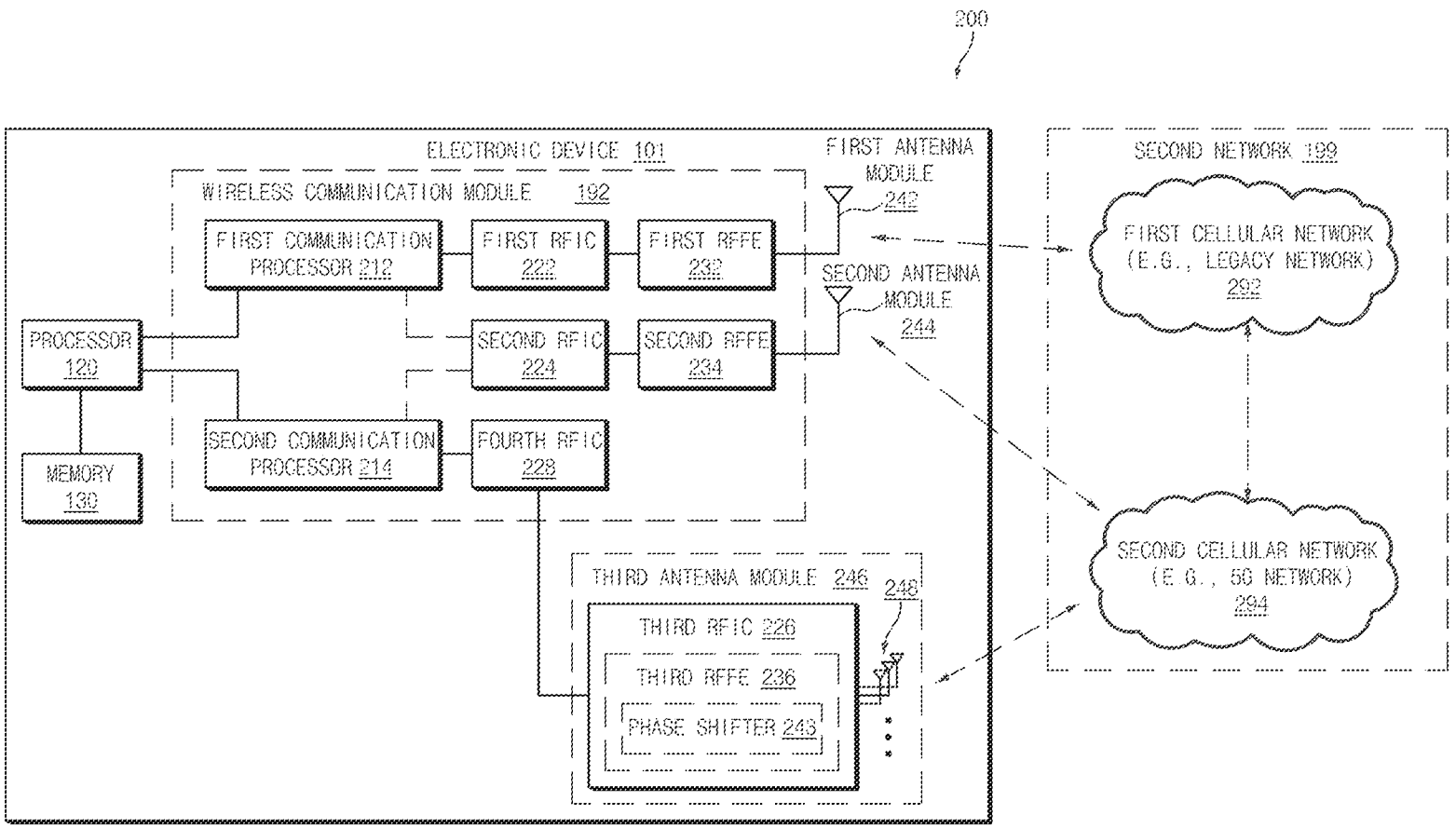
FIG. 2 is a block diagram of an electronic device for supporting legacy network communication and 5G network communication, according to an embodiment of the disclosure.

FIG. 2 is a block diagram 200 of an electronic device 101 for supporting legacy network communication and 5G network communication, according to an embodiment of the disclosure.

Referring to FIG. 2, the electronic device 101 may include a first communication processor 212, a second communication processor 214, a first radio frequency integrated circuit (RFIC) 222, a second RFIC 224, a third RFIC 226, a fourth RFIC 228, a first radio frequency front end (RFFE) 232, a second RFFE 234, a first antenna module 242, a second antenna module 244, and an antenna 248. The electronic device 101 may further include the processor 120 and the memory 130. The network 199 may include a first network 292 and a second network 294. According to another embodiment, the electronic device 101 may further include at least one component of the components illustrated in FIG. 1, and the network 199 may further include at least another network. According to an embodiment, the first communication processor 212, the second communication processor 214, the first RFIC 222, the second RFIC 224, the fourth RFIC 228, the first RFFE 232, and the second RFFE 234 may form at least part of the wireless communication module 192. According to another embodiment, the fourth RFIC 228 may be omitted or included as the part of the third RFIC 226.

The first communication processor 212 may establish a communication channel for a band to be used for wireless communication with the first network 292 and may support legacy network communication through the established communication channel. According to various embodiments, the first network may be a legacy network including a 2nd generation (2G), 3rd generation (3G), 4th generation (4G), or long-term evolution (LTE) network. The second communication processor 214 may support the establishment of a communication channel corresponding to a specified band (e.g., about 6 GHz~about 60 GHz) among bands to be used for wireless communication with the second network 294 and 5G network communication via the established communication channel. According to various embodiments, the second network 294 may be a 5G network defined in 3rd generation partnership project (3GPP). Additionally, according to an embodiment, the first communication processor 212 or the second communication processor 214 may establish a communication channel corresponding to another specified band (e.g., approximately 6 GHz or lower) of the bands to be used for wireless communication with the second network 294 and may support 5G network communication through the established communication channel. According to an embodiment, the first communication processor 212 and the second communication processor 214 may be implemented within a single chip or a single package. According to various embodiments, the first communication processor 212 or the second communication processor 214 may be implemented within a single chip or a single package together with the processor 120, the auxiliary processor 123, or the communication module 190.

In the case of transmitting a signal, the first RFIC 222 may convert a baseband signal generated by the first communication processor 212 into a radio frequency (RF) signal of about 700 MHz to about 3 GHz that is used in the first network 292. In the case of receiving a signal, an RF signal may be obtained from the first network 292 (e.g., a legacy network) through an antenna (e.g., the first antenna module 242) and may be pre-processed through an RFFE (e.g., the first RFFE 232). The first RFIC 222 may convert the preprocessed RF signal to a baseband signal so as to be processed by the first communication processor 212.

In the case of transmitting a signal, the second RFIC 224 may convert a baseband signal generated by the first communication processor 212 or the second communication processor 214 into an RF signal (hereinafter referred to as a "5G Sub6 RF signal") in a Sub6 band (e.g., about 6 GHz or lower) used in the second network 294 (e.g., a 5G network). In the case of receiving a signal, the 5G Sub6 RF signal may be obtained from the second network 294 (e.g., a 5G network) through an antenna (e.g., the second antenna module 244) and may be pre-processed through an RFFE (e.g., the second RFFE 234). The second RFIC 224 may convert the pre-processed 5G Sub6 RF signal into a baseband signal so as to be processed by a communication processor corresponding to the 5G Sub6 RF signal from among the first communication processor 212 or the second communication processor 214.

The third RFIC 226 may convert a baseband signal generated by the second communication processor 214 into an RF signal (hereinafter referred to as a "5G Above6 RF signal") in a 5G Above6 band (e.g., approximately 6 GHz to approximately 60 GHz) to be used in the second network 294 (e.g., a 5G network). In the case of receiving a signal, the 5G Above6 RF signal may be obtained from the second network 294 (e.g., a 5G network) through an antenna (e.g., the antenna 248) and may be preprocessed through a third RFFE 236. The third RFIC 226 may convert the preprocessed 5G Above 6 RF signal to a baseband signal so as to be processed by the second communication processor 214. According to an embodiment, the third RFFE 236 may be formed as the part of the third RFIC 226. The third RFFE 236 may include a phase shifter 243.

According to an embodiment, the electronic device 101 may include the fourth RFIC 228 independent of the third RFIC 226 or as at least part thereof. In this case, the fourth RFIC 228 may convert a baseband signal generated by the second communication processor 214 into an RF signal (hereinafter referred to as an "IF signal") in an intermediate frequency band (e.g., ranging from about 9 GHz to about 11 GHz) and may provide the IF signal to the third RFIC 226. The third RFIC 226 may convert the IF signal to the 5G Above6 RF signal. In the case of receiving a signal, the 5G Above6 RF signal may be received from the second network 294 (e.g., a 5G network) through an antenna (e.g., the antenna 248) and may be converted into an IF signal by the third RFIC 226. The fourth RFIC 228 may convert the IF signal to the baseband signal such that the second communication processor 214 is capable of processing the baseband signal.

According to an embodiment, the first RFIC 222 and the second RFIC 224 may be implemented with a part of a single chip or a single package. According to an embodiment, the first RFFE 232 and the second RFFE 234 may be implemented as at least part of a single chip or a single package. According to an embodiment, at least one antenna module of the first antenna module 242 or the second antenna module 244 may be omitted or may be coupled to another antenna module and then may process RF signals of a plurality of corresponding bands.

According to an embodiment, the third RFIC 226 and the antenna 248 may be disposed on the same substrate to form the third antenna module 246. For example, the wireless communication module 192 or the processor 120 may be disposed on a first substrate (e.g., a main PCB). In this case, the third RFIC 226 may be disposed in a partial region (e.g., a bottom surface) of a second substrate (e.g., sub PCB) separately of the first substrate; the antenna 248 may be disposed in another partial region (e.g., an upper surface), and thus the third antenna module 246 may be formed. According to an embodiment, for example, the antenna 248 may include an antenna array capable of being used for beamforming. It is possible to reduce the length of the transmission line between the third RFIC 226 and the antenna 248 by positioning the third RFIC 226 and the antenna 248 on the same substrate. The decrease in the transmission line may make it possible to reduce the loss (or attenuation) of a signal in a high-frequency band (e.g., approximately 6 GHz to approximately 60 GHz) used for the 5G network communication due to the transmission line. As such, the electronic device 101 may improve the quality or speed of communication with the second network 294 (e.g., a 5G network).

The second network 294 (e.g., a 5G network) may be used independently of the first network 292 (e.g., a legacy network) (e.g., stand-alone (SA)) or may be used in conjunction with the first network 198 (e.g., non-stand alone (NSA)). For example, only an access network (e.g., a 5G radio access network (RAN) or a next generation RAN (NG RAN)) may be present in the 5G network, and a core network (e.g., a next generation core (NGC)) may be absent from the 5G network. In this case, the electronic device 101 may access the access network of the 5G network and may then access an external network (e.g., Internet) under control of the core network (e.g., an evolved packed core (EPC)) of the legacy network. Protocol information (e.g., LTE protocol information) for communication with the legacy network or protocol information (e.g., New Radio NR protocol information) for communication with the 5G network may be stored in the memory 130 so as to be accessed by another component (e.g., the processor 120, the first communication processor 212, or the second communication processor 214).

Figure 3A:
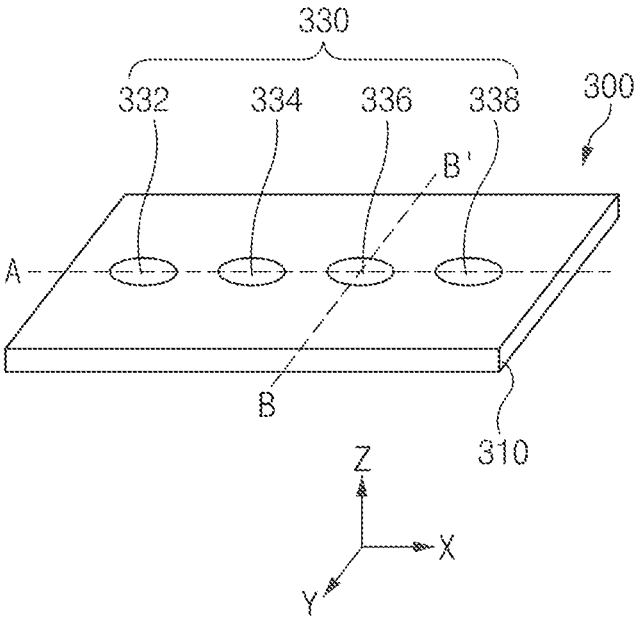
FIG. 3A is a perspective view of a third antenna module when viewed from one side according to an embodiment of the disclosure.
Figure 3B:
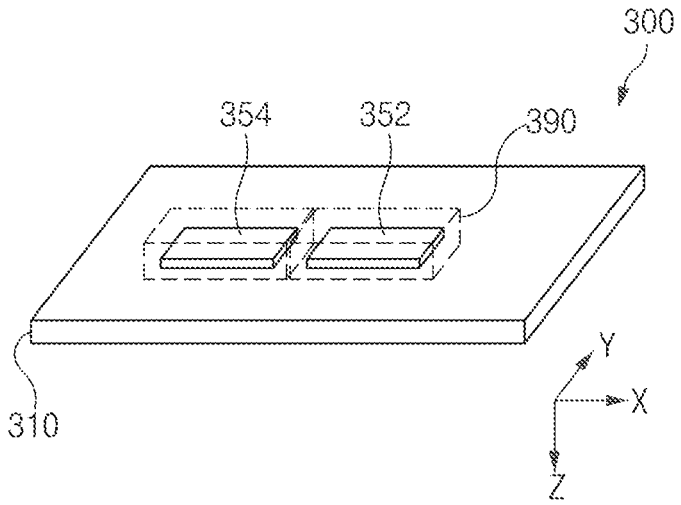
FIG. 3B is a perspective view of a third antenna module when viewed from another side according to an embodiment of the disclosure.
Figure 3C:
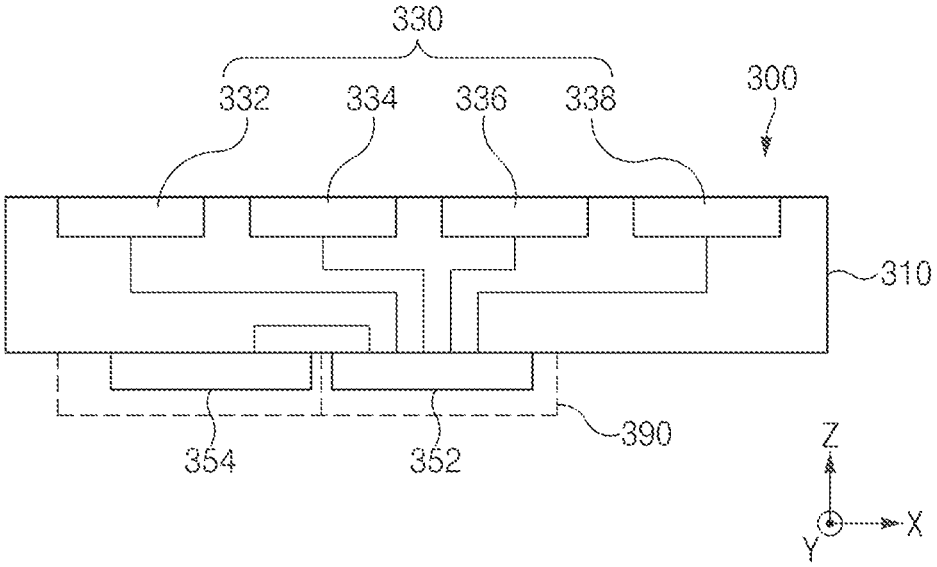
FIG. 3C is a cross-sectional view of a third antenna module taken along a line A-A' according to an embodiment of the disclosure.

FIGS. 3A, 3B and 3C illustrate various views (diagram 300) of an embodiment of the third antenna module 246 described with reference to FIG. 2, for example.

FIG. 3A is a perspective view of the third antenna module 246 when viewed from one side according to an embodiment of the disclosure, and FIG. 3B is a perspective view of the third antenna module 246 when viewed from another side according to an embodiment of the disclosure. FIG. 3C is a cross-sectional view of the third antenna module 246 taken along a line A-A' according to an embodiment of the disclosure.

Referring to FIGS. 3A, 3B and 3C, in an embodiment, the third antenna module 246 may include a printed circuit board 310, an antenna array 330, a radio frequency integrated circuit (RFIC) 352, a power management integrated circuit (PMIC) 354, and a module interface. Selectively, the third antenna module 246 may further include a shielding member 390. In various embodiments, at least one of the above components may be omitted, or at least two of the components may be integrally formed.

The printed circuit board 310 may include a plurality of conductive layers and a plurality of non-conductive layers, and the conductive layers and the non-conductive layers may be alternately stacked. The printed circuit board 310 may provide electrical connection with various electronic components disposed on the printed circuit board 310 or on the outside, by using wires and conductive vias formed in the conductive layers.

The antenna array 330 (e.g., 248 of FIG. 2) may include a plurality of antenna elements 332, 334, 336, and 338 disposed to form a directional beam. As shown in FIG. 2, the antenna elements may be formed on a first surface of the printed circuit board 310 as illustrated. According to another embodiment, the antenna array 330 may be formed within the printed circuit board 310. According to embodiments, the antenna array 330 may include a plurality of antenna arrays (e.g., a dipole antenna array and/or a patch antenna array), the shapes or kinds of which are identical or different.

The RFIC 352 (e.g., 226 of FIG. 2) may be disposed on another region (e.g., a second surface facing away from the first surface) of the printed circuit board 310 so as to be spaced from the antenna array. The RFIC may be configured to process a signal in the selected frequency band, which is transmitted/received through the antenna array 330. According to an embodiment, in the case of transmitting a signal, the RFIC 352 may convert a baseband signal obtained from a communication processor (not illustrated) into an RF signal. In the case of receiving a signal, the RFIC 352 may convert an RF signal received through the antenna array 330 into a baseband signal and may provide the baseband signal to the communication processor.

According to another embodiment, in the case of transmitting a signal, the RFIC 352 may up-convert an IF signal (e.g., approximately 9 GHz to approximately 11 GHz) obtained from an intermediate frequency integrated circuit (IFIC) (e.g., 228 of FIG. 2) into an RF signal. In the case of receiving a signal, the RFIC 352 may down-convert an RF signal obtained through the antenna array, RFIC 352, into an IF signal and may provide the IF signal to the IFIC.

The PMIC 354 may be disposed on another region (e.g., the second surface) of the printed circuit board 310, which is spaced from the antenna array. The PMIC may be supplied with a voltage from a main PCB (not illustrated) and may provide a power necessary for various components (e.g., the RFIC 352) on an antenna module.

The shielding member 390 may be disposed at a portion (e.g., on the second surface) of the printed circuit board 310 such that at least one of the RFIC 352 or the PMIC 354 is electromagnetically shielded. According to an embodiment, the shielding member 390 may include a shield can.

Although not illustrated in drawings, in various embodiments, the third antenna module 246 may be electrically connected with another printed circuit board (e.g., a main circuit board) through a module interface. The module interface may include a connection member, for example, a coaxial cable connector, a board to board connector, an interposer, or a flexible printed circuit board (FPCB). The RFIC 352 and/or the PMIC 354 of the third antenna module 1246 may be electrically connected with the printed circuit board through the connection member.

Figure 4:
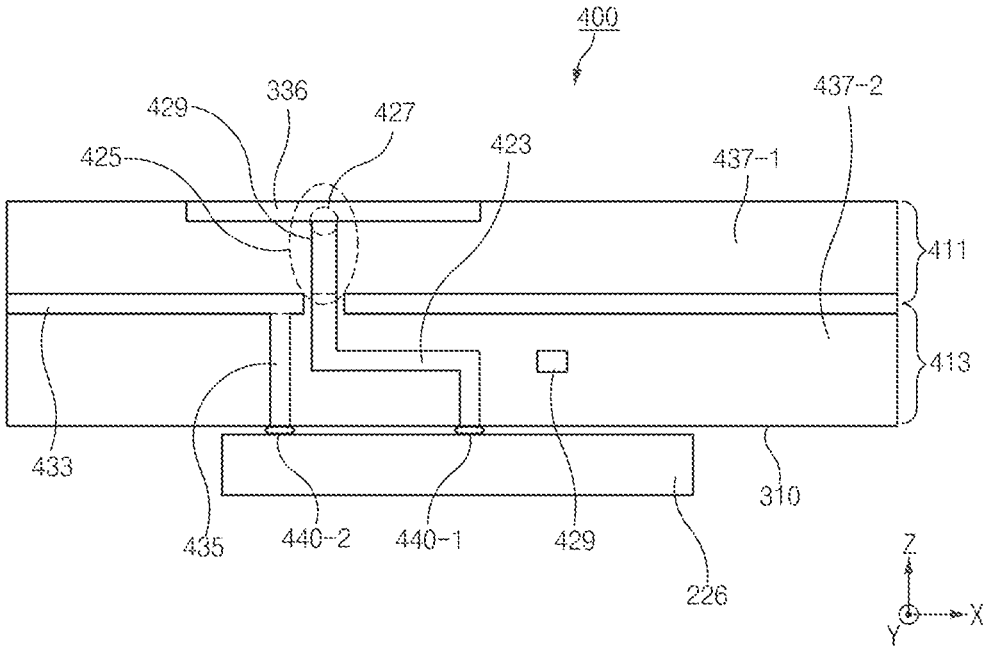
FIG. 4 illustrates a cross-sectional view of a third antenna module taken along a line B-B' of FIG. 3A according to an embodiment of the disclosure.

FIG. 4 illustrates a cross-sectional view (diagram 400) of the third antenna module 246 taken along a line B-B' of FIG. 3A according to an embodiment of the disclosure.

Referring to FIG. 4, the printed circuit board 310 may include an antenna layer 411 and a network layer 413.

The antenna layer 411 may include at least one dielectric layer 437-1, and an antenna element 336 and/or a feed part 425 formed on an outer surface of the dielectric layer 1437-1 or therein. The feed part 425 may include a feed point 427 and/or a feed line 429.

The network layer 413 may include at least one dielectric layer 437-2 and at least one ground layer 433, at least one conductive via 435, a transmission line 423, and/or a signal line 429 formed on an outer surface of the dielectric layer 437-2 or therein.

In addition, in the embodiment illustrated, the third RFIC 226 of FIG. 2 may be electrically connected with the network layer 413, for example, through first and second connection parts (e.g., solder bumps) 440-1 and 440-2. In various embodiments, various connection structures (e.g., soldering or a ball grid array (BGA)) may be utilized instead of the connection parts. The third RFIC 226 may be electrically connected with the antenna element 336 through the first connection part 440-1, the transmission line 423, and the feed part 425. Also, the third RFIC 226 may be electrically connected with the ground layer 433 through the second connection part 440-2 and the conductive via 435. Although not illustrated, the third RFIC 226 may also be electrically connected with the above module interface through a signal line 429.

Figure 5:
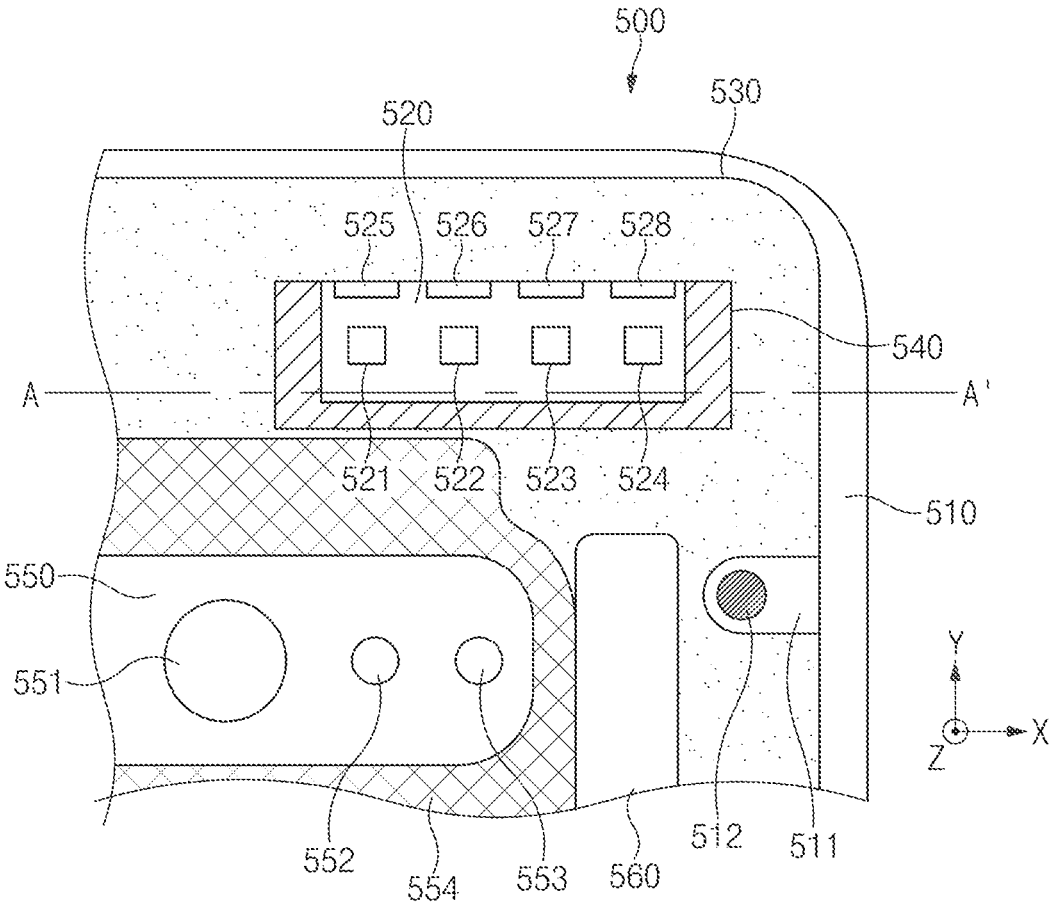
FIG. 5 is a diagram illustrating an electronic device including an antenna module, according to an embodiment of the disclosure.

FIG. 5 is a diagram 500 illustrating an electronic device (e.g., the electronic device 101 of FIG. 1) including an antenna module 520, according to an embodiment of the disclosure.

The electronic device 101 according to an embodiment may include a housing 510, an antenna module 520, an injection-molding material 530, or a conductive pattern 540.

In an embodiment, the housing 510 may include a first plate, a second plate facing away from the first plate, and a side member surrounding a space between the first plate and the second plate, connected to the second plate or integrally formed with the second plate, and including a conductive material. An extending portion 511 may be formed between the first and second plates from the side member of the housing 510. The extending portion 511 may include a fixing portion 512 capable of fixing the extending portion 511 to the first and second plates.

In an embodiment, the injection-molding material 530 may be positioned inside the housing 510. The injection-molding material 530 may be positioned in the space between the first plate and the second plate. The injection-molding material 530 may be made of a non-conductive material. The injection-molding material 530 may be non-conductive plastic. The injection-molding material 530 may fill the space between the first and second plates of the housing 510. The injection-molding material 530 may fix the location of the antenna module 520 disposed inside the housing 510.

In an embodiment, the antenna module 520 may be supported by the injection-molding material 530. For example, the antenna module 520 may be mounted in the injection-molding material 530 or may be fixed by the injection-molding material 530. For another example, the antenna module 520 may be supported by a support member (e.g., the support member 570 of FIG. 7). The support member 570 may be made of injection or metal such as stainless steel (Sus). First to fourth patch antennas 521, 522, 523, and 524 may be disposed in the antenna module 520. First to fourth dipole antennas 525, 526, 527, and 528 may be disposed in a direction facing the side member of the housing 510 of the antenna module 520.

In an embodiment, the conductive pattern 540 may be disposed on the injection-molding material 530. The conductive pattern 540 may be disposed in the horizontal direction (X-axis direction). The conductive pattern 540 may be patterned and disposed on the injection-molding material 530. For example, the conductive pattern 540 may be generated by generating a plating pattern on the injection-molding material 530 (e.g., using laser direct structuring (LDS)). The conductive pattern 540 may be disposed to be at least partially adjacent to the edge of the antenna module 520. The conductive pattern 540 may be formed of a metal guide structure in the first side direction (−X axis direction), the second side direction (−Y axis direction), and the third side direction (+X axis direction) of the antenna module 520. The conductive pattern 540 may suppress the surface wave that propagates from the antenna module 520 to the injection-molding material 530. The conductive pattern 540 may suppress signal sources generated by the surface wave. The conductive pattern 540 may attenuate the reflected wave that is reflected from the antenna module 520 by a rear cover (not illustrated) and then is incident to the injection-molding material 530. The conductive pattern 540 may suppress undesired signal sources to reduce the distortion of the beam radiated from the antenna module 520.

In an embodiment, the conductive pattern 540 may be disposed to surround the edge of the antenna module 520.

The conductive pattern 540 may be a metal guide structure in the form surrounding the periphery of the antenna module 520. For example, the conductive pattern 540 may be disposed to surround at least part (e.g., four surfaces) of the edges of the antenna module 520.

In an embodiment, the conductive pattern 540 may be disposed to surround edges other than the edge in which the first to fourth dipole antennas 525, 526, 527, and 528 of the antenna module 520 are disposed. For the purpose of not affecting the radiation patterns of the first to fourth dipole antennas 525, 526, 527, and 528 disposed in the antenna module 520, the conductive pattern 540 may be disposed on three surfaces other than the edge in which the first to fourth dipole antennas 525, 526, 527 and 528 are disposed.

In an embodiment, the electronic device 101 may further include a camera 550. The camera 550 may be disposed adjacent to the conductive pattern 540. A camera deco 554 may be positioned to surround the camera 550 in the edge of the camera 550. The camera deco 554 may be positioned on the injection-molding material 530. The camera deco 554 may fix or support the camera 550 to a specified location. The camera deco 554 may be a support member made of metal, such as stainless steel (Sus). The camera deco 554 may be used as the part of the conductive pattern 540. The camera 550 may include first to third camera sensors 551, 552, and 553. The camera 550 may take pictures, using the first to third camera sensors 551, 552 and 553.

In an embodiment, the electronic device 101 may further include the printed circuit board 560. When viewed from above the second plate, the printed circuit board 560 may be disposed on the antenna module 520 and a lower layer of the injection-molding material 530. For example, as illustrated in FIG. 5, the printed circuit board 560 may be spaced from the conductive pattern 540. However, an embodiment is not limited thereto. When the conductive pattern 540 is used as at least part of the antenna, the printed circuit board 560 may be electrically and/or physically connected to the conductive pattern 540.

Figure 6:
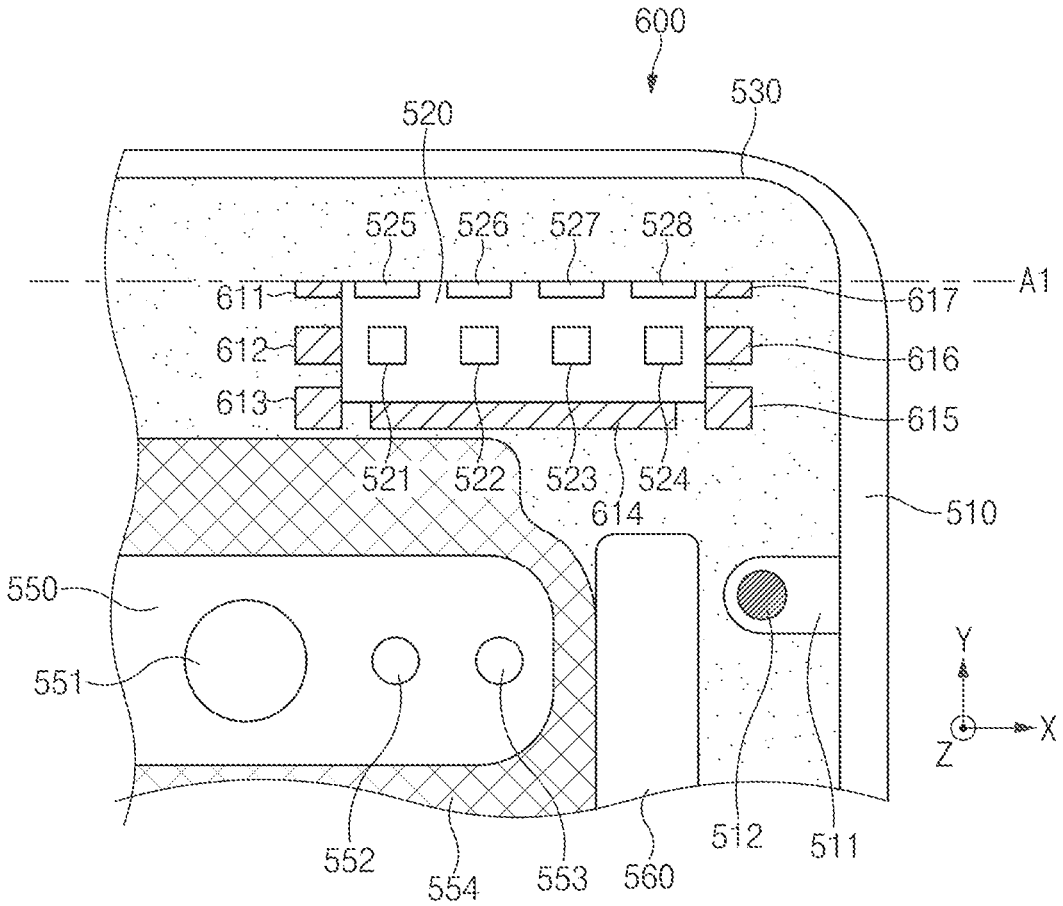
FIG. 6 is a diagram illustrating an electronic device including an antenna module, according to an embodiment of the disclosure.

FIG. 6 is a diagram 600 illustrating an electronic device (e.g., the electronic device 101 of FIG. 1) including an antenna module 520, according to an embodiment of the disclosure.

The electronic device 101 according to another embodiment may include the housing 510, the antenna module 520, the injection-molding material 530, first to seventh sub patterns 611, 612, 613, 614, 615, 616, and 617, the camera 550, and/or the printed circuit board 560. According to another embodiment, the housing 510, the antenna module 520, the injection-molding material 530, the camera 550, and the printed circuit board 560 of the electronic device 101 are substantially the same as the housing 510, the antenna module 520, the injection-molding material 530, the camera 550, and the printed circuit board 560 described in FIG. 5, and thus the description thereof is omitted.

In an embodiment, the first to seventh sub patterns 611, 612, 613, 614, 615, 616, and 617 may be disposed adjacent to the edge of the antenna module 520. For example, the first to seventh sub patterns 611, 612, 613, 614, 615, 616, and 617 may be positioned at a location close to the antenna module 520 among locations where the coupling with the antenna module 520 does not occur. The first to seventh sub patterns 611, 612, 613, 614, 615, 616, and 617 may be formed of substantially the same material as the conductive pattern 540 of FIG. 5. Each of the first to seventh sub patterns 611, 612, 613, 614, 615, 616, and 617 may be spaced from one another.

In an embodiment, the first to third sub patterns 611, 612, and 613 may be disposed adjacent to the edge of the first side direction (−X axis direction) of the antenna module 520. The first sub pattern 611 adjacent to the first dipole antenna 525 may be disposed in parallel with the edge of the fourth side direction (+Y axis direction) of the antenna module 520 that is positioned in a direction in which the first to fourth dipole antennas 525, 526, 527, and 528 form beams. For example, for the purpose of preventing the performance of the first to fourth dipole antennas 525, 526, 527, and 528 to be affected, the first sub pattern 611 may be disposed such that the virtual first straight line A1 extending from the edge of the fourth side direction (+Y axis direction) of the antenna module 520 does not cross in +Y axis direction. The fourth sub pattern 614 may be disposed adjacent to the edge of the second side direction (−Y axis direction) of the antenna module 520. The seventh sub pattern 617 may be disposed adjacent to the edge of the third side direction (+X axis direction) of the antenna module 520 so as to correspond to the first sub pattern 611. For example, the seventh sub pattern 617 may be disposed such that the virtual first straight line A1 extending from the edge of the fourth side direction (+Y axis direction) of the antenna module 520 does not cross in +Y axis direction. The fifth to sixth sub patterns 615 and 616 may be disposed adjacent to the edge of a third side direction (+X axis direction) of the antenna module 520.

Figure 7:
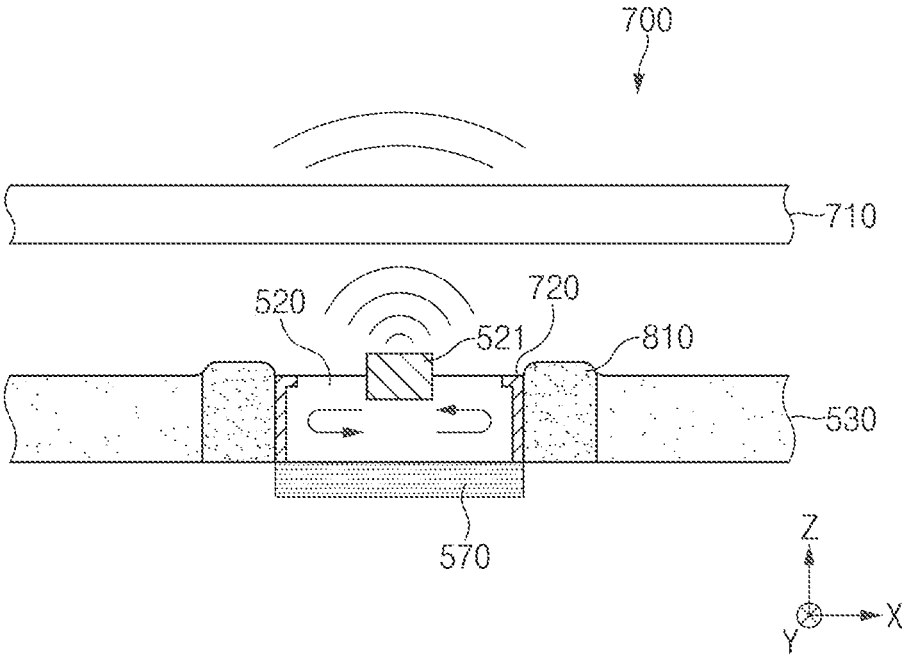
FIG. 7 is a diagram illustrating a signal radiated by an antenna module, according to an embodiment of the disclosure.

FIG. 7 is a diagram 700 illustrating a signal radiated by the antenna module 520, according to an embodiment of the disclosure.

In an embodiment, the antenna module 520 may radiate a signal to the outside of the electronic device (e.g., the electronic device 101 of FIG. 1) through the rear cover 710. The first patch antenna 521 included in the antenna module 520 may radiate a signal in a direction facing the rear cover 710.

In an embodiment, the injection-molding material 530 may be disposed around the antenna module 520. The injection-molding material 530 may fix the location of the antenna module 520. When the signal is transmitted by the antenna module 520 to the injection-molding material 530 in the form of a surface wave, the undesired signal radiation may occur in the injection-molding material 530, and thus the distortion of the signal may occur.

In an embodiment, the conductive pattern 720 may be disposed on both sides of the antenna module 520. The conductive pattern 720 may be disposed in a first vertical direction (+Z axis direction). For example, the conductive pattern 720 may be formed of a metal member of a stainless steel (Sus) that fixes the antenna module 520. For another example, the conductive pattern 720 may be formed in the form of plating in the side portion (e.g., the edge disposed in the first side direction (−X axis direction), the second side direction (−Y axis direction), and the third side direction (+X axis direction) of FIG. 5) of the antenna module 520. For still another example, the conductive pattern 720 may be formed in a form such as printing or plating on the side surface of the injection-molding material 530. The conductive pattern 720 may prevent the signal radiated by the antenna module 520 from propagating to the injection-molding material 530. The conductive pattern 720 surrounding the antenna module 520 may prevent the radiation of undesired signals from occurring in the injection-molding material 530 and may reduce the distortion of a signal.

In an embodiment, the support member 570 may be disposed on one surface disposed in the second vertical direction (—Z axis direction) in one surface of the antenna module 520. The support member 570 may fix the location of the antenna module 520.

In an embodiment, the protrusion portion 810 may be formed in the injection-molding material 530. The protrusion portion 810 may be disposed in a portion adjacent to the conductive pattern 720 in the injection-molding material 530. The protrusion portion 810 may be disposed to surround the conductive pattern 720. The protrusion portion 810 may be formed to have a height higher than that of the conductive pattern 720. The protrusion portion 810 may support or fix the conductive pattern 720.

Figure 8:
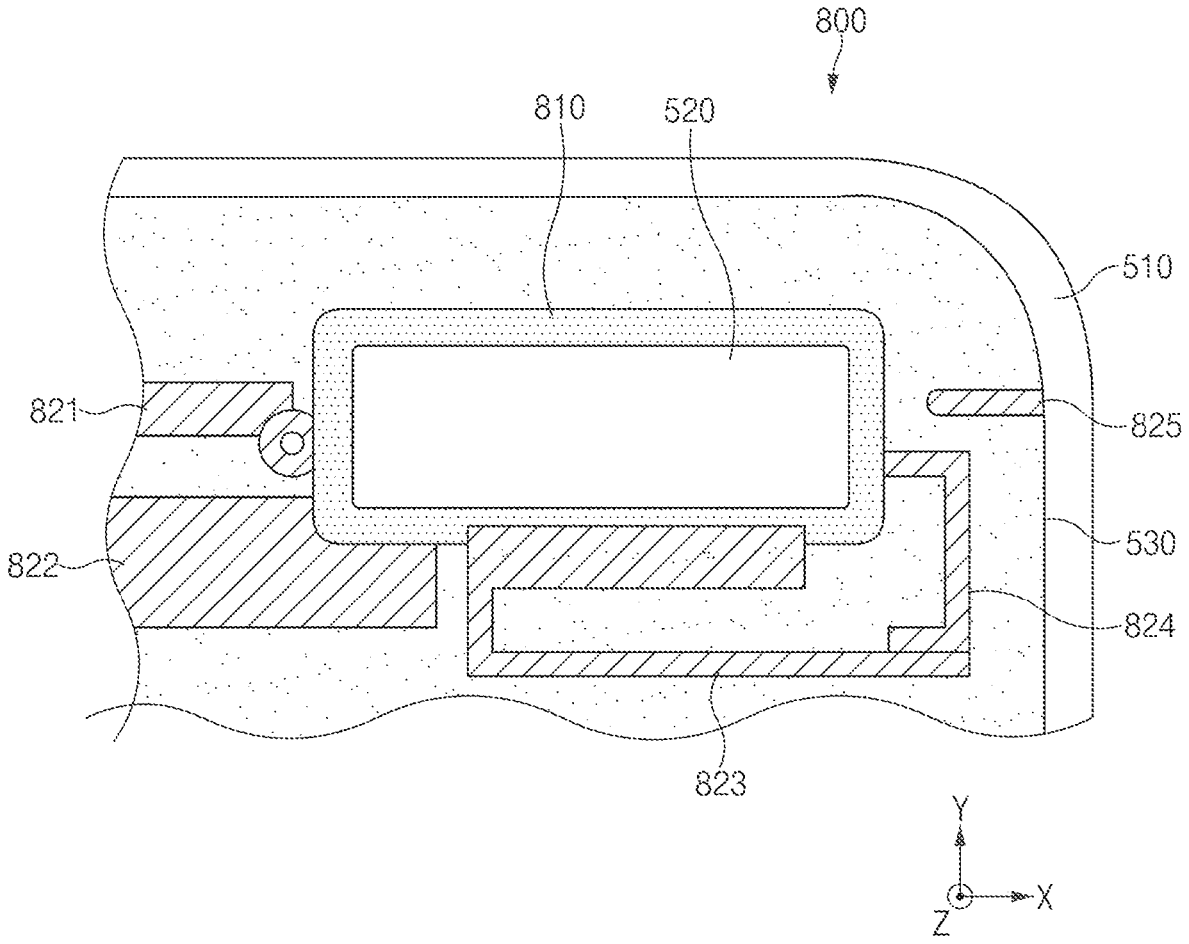
FIG. 8 is a diagram illustrating an antenna module, a protrusion portion, and a plurality of conductive patterns, according to an embodiment of the disclosure.

FIG. 8 is a diagram 800 illustrating the antenna module 520, a protrusion portion 810, and a plurality of conductive patterns 821, 822, 823, 824, and 825, according to an embodiment of the disclosure.

In an embodiment, the housing 510 may include a first plate, a second plate facing away from the first plate, and a side member surrounding a space between the first plate and the second plate, connected to the second plate or integrally formed with the second plate, and including a conductive material.

In an embodiment, the injection-molding material 530 may be disposed in the space between the first plate and the second plate inside the housing 510 and may be made of a non-conductive material.

In an embodiment, the antenna module 520 may be supported by the injection-molding material 530. For example, the antenna module 520 may be mounted in the injection-molding material 530 or may be fixed by the injection-molding material 530.

In an embodiment, the protrusion portion 810 may surround the edge of the antenna module 520. The protrusion portion 810 may be made of a non-conductive material. The protrusion portion 810 may have a height higher than the injection-molding material 530. The protrusion portion 810 may serve as a guide for mounting or fixing the antenna module 520.

In an embodiment, first to fifth conductive patterns 821, 822, 823, 824, and 825 may be disposed in the injection-molding material 530. The first to fifth conductive patterns 821, 822, 823, 824, and 825 may be disposed to be at least partially adjacent to the protrusion portion 810.

In an embodiment, the first conductive pattern 821 may be used as a legacy antenna for 3G or 4G communication. The second conductive pattern 822 may prevent the surface wave from propagating to the injection-molding material 530. The first conductive pattern 821 and the second conductive pattern 822 may be spaced from each other. The 3G or 4G communication signal radiated by the first conductive pattern 821 may not be affected by the second conductive pattern 822.

In an embodiment, the first to fifth conductive patterns 821, 822, 823, 824, and 825 may extend from the antenna module 520 in at least one of the first side direction (−X axis direction), the second side direction (−Y axis direction), the third side direction (+X axis direction), or the fourth side direction (+Y axis direction). For example, the first to fifth conductive patterns 821, 822, 823, 824, and 825 may extend to face the first side surface, the second side surface, the third side surface, and/or the fourth side surface that constitute the side member of the housing 510. When the area of the first to fifth conductive patterns 821, 822, 823, 824, and 825 increases, the performance of preventing a signal from propagating to the injection-molding material 530 may be increased.

In an embodiment, the first to fifth conductive patterns 821, 822, 823, 824, and 825 may be formed adjacent to the protrusion portion 810. For another example, at least some regions of the third conductive pattern 823 may overlap with at least some regions of the protrusion portion 810. When the first to fifth conductive patterns 821, 822, 823, 824, and 825 are formed adjacent to the protrusion portion 810 or overlap with at least some regions of the protrusion portion 810, the performance of preventing a signal from propagating to the injection-molding material 530 may be increased.

In an embodiment, the protrusion portion 810 may be the same material as the injection-molding material 530. Each of the protrusion portion 810 and the injection-molding material 530 may be a non-conductive plastic. When the protrusion portion 810 and the injection-molding material 530 are formed of a material the same as each other, the protrusion portion 810 and the injection-molding material 530 may be formed through a single process.

In an embodiment, when the antenna module 520 is viewed in the X axis direction, the protrusion portion 810 may further protrude in the first vertical direction (+Z axis direction) than the antenna module 520. The protrusion portion 810 may have a height higher than the height of the antenna module 520 to serve as a guide for stably mounting the antenna module 520.

In an embodiment, at least part of the first to fifth conductive patterns 821, 822, 823, 824, and 825 may contact the protrusion portion 810. For example, at least part of the first, second, and fourth conductive patterns 821, 822, and 824 may contact the protrusion portion 810. When at least part of the first to fifth conductive patterns 821, 822, 823, 824, and 825 is in contact with the protrusion portion 810, it may further prevent the signal from being transmitted from the antenna module 520 to the injection-molding material 530.

Figure 9:
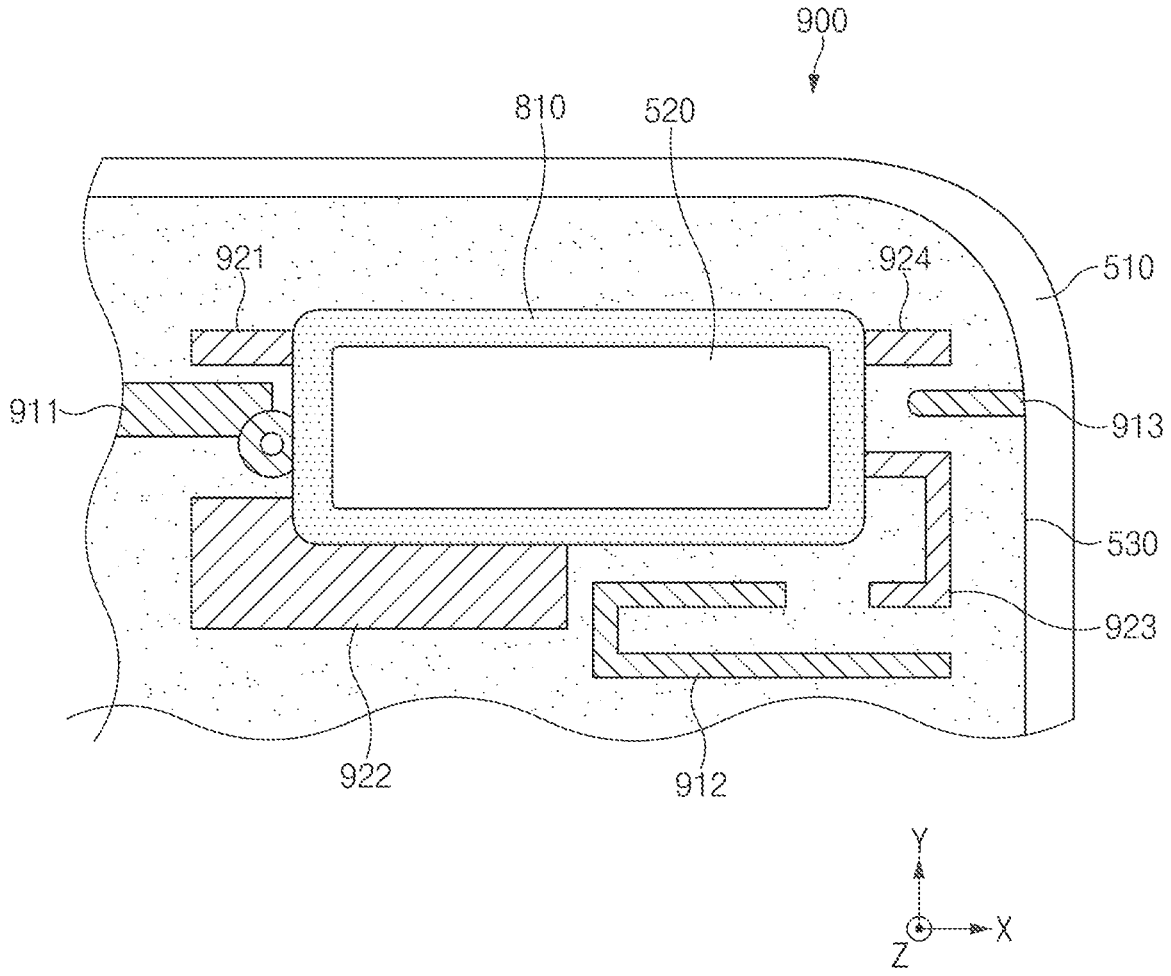
FIG. 9 is a diagram illustrating an antenna module, a protrusion portion, a plurality of antenna radiators, and a plurality of conductive patterns, according to an embodiment of the disclosure.

FIG. 9 is a diagram 900 illustrating the antenna module 520, the protrusion portion 810, a plurality of antenna radiators 911, 912, 913, and/or a plurality of conductive patterns 921, 922, 923, and 924, according to an embodiment of the disclosure.

The housing 510, the antenna module 520, the injection-molding material 530, and the protrusion portion 810 of FIG. 9 are substantially the same as the housing 510, the antenna module 520, the injection-molding material 530, and the protrusion portion 810 of FIG. 8, and thus a description thereof is omitted.

In an embodiment, first to third antenna radiators 911, 912, and 913 may be disposed adjacent to the antenna module 520. The first to third antenna radiator 911, 912, and 913 may be disposed on the injection-molding material 530. For example, the first to third antenna radiator 911, 912, and 913 may be used as legacy antennas. The first to third antenna radiators 911, 912, and 913 may be formed adjacent to the antenna module 520 so as to reduce the surface wave induced to the injection-molding material 530. The first to third antenna radiator 911, 912, and 913 may be at least partially adjacent to the protrusion portion 810. The first to third antenna radiator 911, 912, and 913 may be spaced apart from the first to fourth conductive pattern 921, 922, 923, and 924. The first to fourth conductive patterns 921, 922, 923, and 924 may prevent the signal from being transmitted in the form of a surface wave from the antenna module 520 to the injection-molding material 530.

Figure 10:
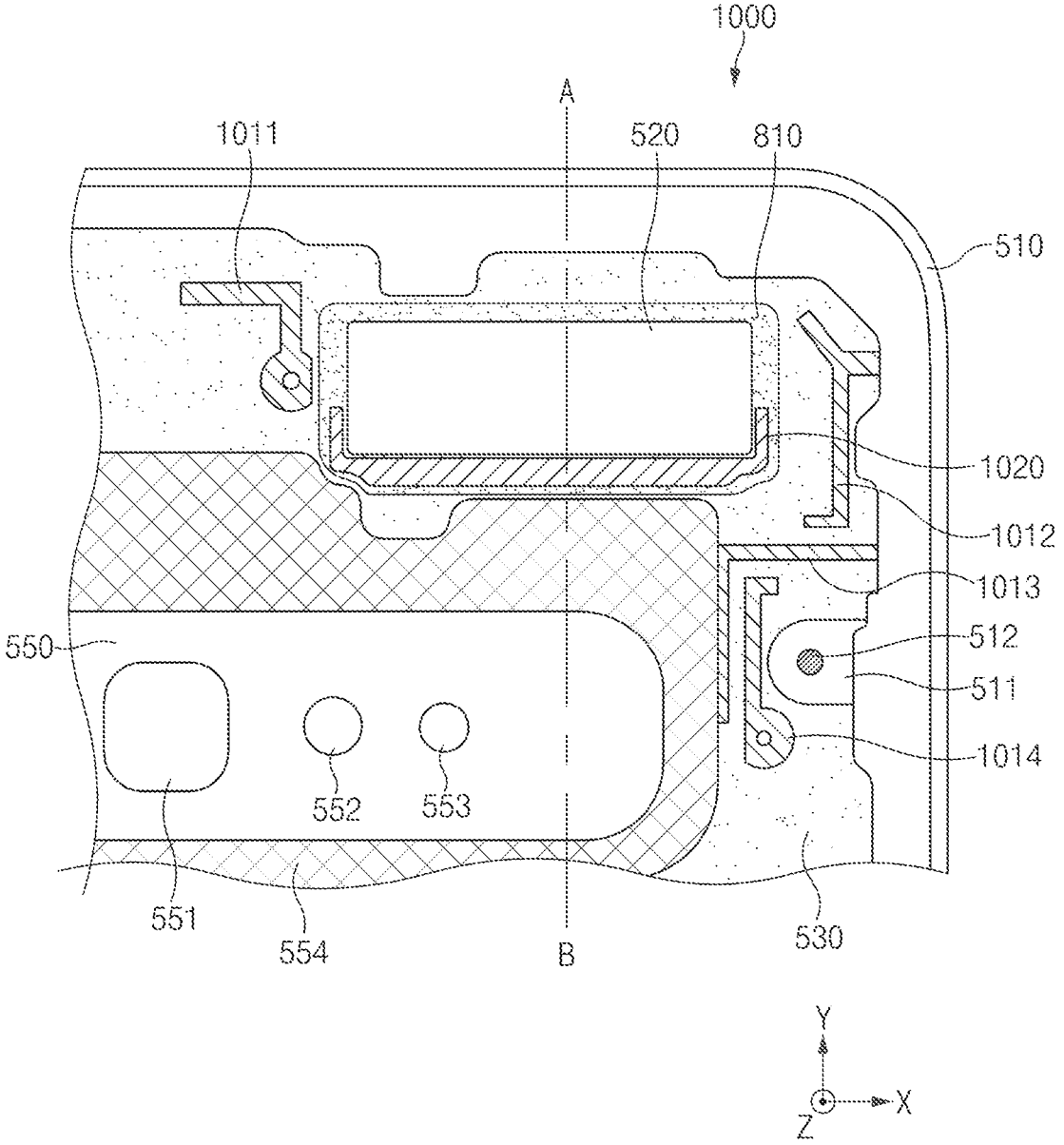
FIG. 10 is a diagram illustrating an electronic device, according to an embodiment of the disclosure.

FIG. 10 is a diagram 1000 illustrating an electronic device (e.g., the electronic device 101 of FIG. 1), according to an embodiment of the disclosure.

The electronic device 101 according to an embodiment may include the housing 510, the antenna module 520, the injection-molding material 530, and/or a conductive pattern 1020. The housing 510, the antenna module 520, and the injection-molding material 530 of FIG. 10 are substantially the same as the housing 510, the antenna module 520, and the injection-molding material 530 of FIG. 5, and thus a description thereof is omitted.

In an embodiment, the conductive pattern 1020 may be supported by the injection-molding material 530. The conductive pattern 1020 may be disposed adjacent to at least one edge formed in the inner direction of the housing 510 among the edges of the antenna module 520. For example, the conductive pattern 1020 may surround the whole of one edge (e.g., the edge of the second side direction (−Y axis direction)) of the antenna module 520. The conductive pattern 1020 may surround at least part of the edge of the first side direction (−X axis direction) and the edge of the third side direction (+X axis direction) of the antenna module 520. For example, the conductive pattern 1020 may surround an edge adjacent to the second side direction (−Y axis direction) in the edge of the first side direction (−X axis direction) and the third side direction (+X axis direction) of the antenna module 520.

In an embodiment, the electronic device 101 may further include first to fourth antenna radiators 1011, 1012, 1013, and 1014. The first to fourth antenna radiators 1011, 1012, 1013, and 1014 may be disposed on the injection-molding material 530.

In an embodiment, the first to fourth antenna radiators 1011, 1012, 1013, and 1014 may be spaced from the antenna module 520 and the conductive pattern 1020. The first to fourth antenna radiators 1011, 1012, 1013, and 1014 may operate as at least one legacy antenna. The first to fourth antenna radiators 1011, 1012, 1013, and 1014 may reduce the transmission of the signal in the form of the surface wave from the antenna module 520 to the injection-molding material 530, to be substantially the same as the conductive pattern 1020. The first to fourth antenna radiators 1011, 1012, 1013, and 1014 may perform communication in a frequency band of wireless communication (e.g., 3G, 4G, LTE frequency band, Wi-Fi, global positioning system (GPS), and/or Sub-6 GHz (3.5 GHz)). The antenna module 520 may perform communication of millimeter wave (mm-Wave). The conductive pattern 1020 may reduce the transmission of the signal in the form of the surface wave from the antenna module 520 to the injection-molding material 530.

Figure 11:
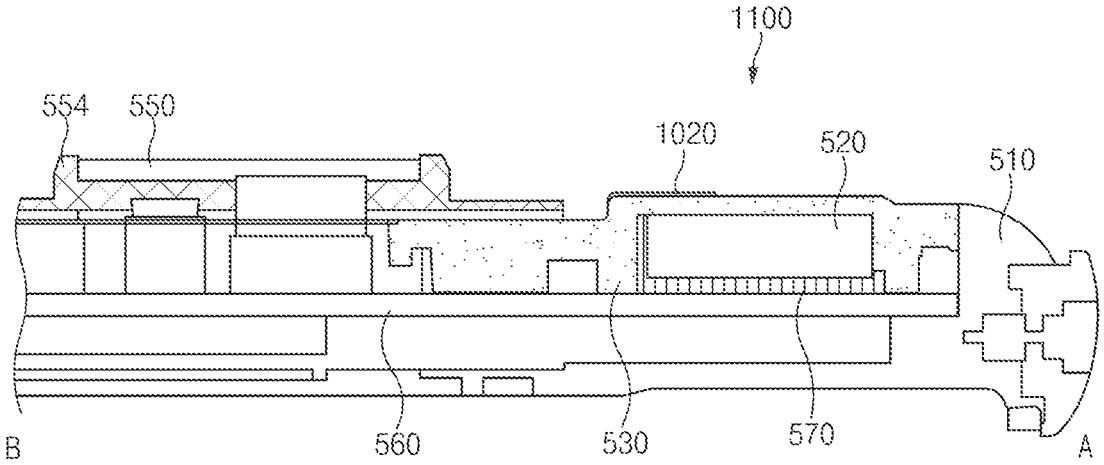
FIG. 11 is a cross-sectional view taken along a line A-B of FIG. 10 according to an embodiment of the disclosure.

FIG. 11 is a cross-sectional view 1100 taken along a line A-B of FIG. 10 according to an embodiment of the disclosure.

An electronic device (e.g., the electronic device 101 of FIG. 1) may include the housing 510, the antenna module 520, the injection-molding material 530, the camera 550, and/or the conductive pattern 1020. The housing 510, the antenna module 520, the injection-molding material 530, and the camera 550 of FIG. 11 are substantially the same as the housing 510, the antenna module 520, the injection-molding material 530, and the camera 550 of FIG. 5, and thus a description thereof is omitted.

In an embodiment, the antenna module 520 may be fixed by the support member 570. The support member 570 may be disposed on the printed circuit board 560. The support member 570 may be surrounded by the injection-molding material 530. For example, the support member 570 may be formed to a height at which at least one side surface corresponds to the antenna module 520. The support member 570 may be made of injection or metal such as stainless steel (Sus).

In an embodiment, the conductive pattern 1020 may be at least partially disposed on the injection-molding material 530. For example, the conductive pattern 1020 may be disposed on at least part of the injection-molding material 530 disposed adjacent to the antenna module 520. At least part of the injection-molding material 530 around the antenna module 520 may be formed to protrude further than the antenna module 520. The conductive pattern 1020 may be disposed at the periphery of the antenna module 520. For example, when viewed from the top, the conductive pattern 1020 may be disposed around the antenna module 520 in a shape such as L-type, C-type, or I-type. The conductive pattern 1020 may block the transmission of the signal from the antenna module 520 to the injection-molding material 530 in the form of the surface wave.

In an embodiment, the electronic device 101 may further include the printed circuit board 560. The printed circuit board 560 may be interposed between the injection-molding material 530 and the first plate.

In an embodiment, the conductive pattern 1020 may be connected to a ground layer (e.g., the ground layer 433 of FIG. 4) or a communication module (e.g., communication module 190 of FIG. 1). The conductive pattern 1020 may be connected to the ground layer 433 or the communication module 190 in the form of at least one via or C-clip so as to be used as a part of an antenna (e.g., the antenna radiators 911, 912, and 913 of FIG. 9).

Figure 12A:
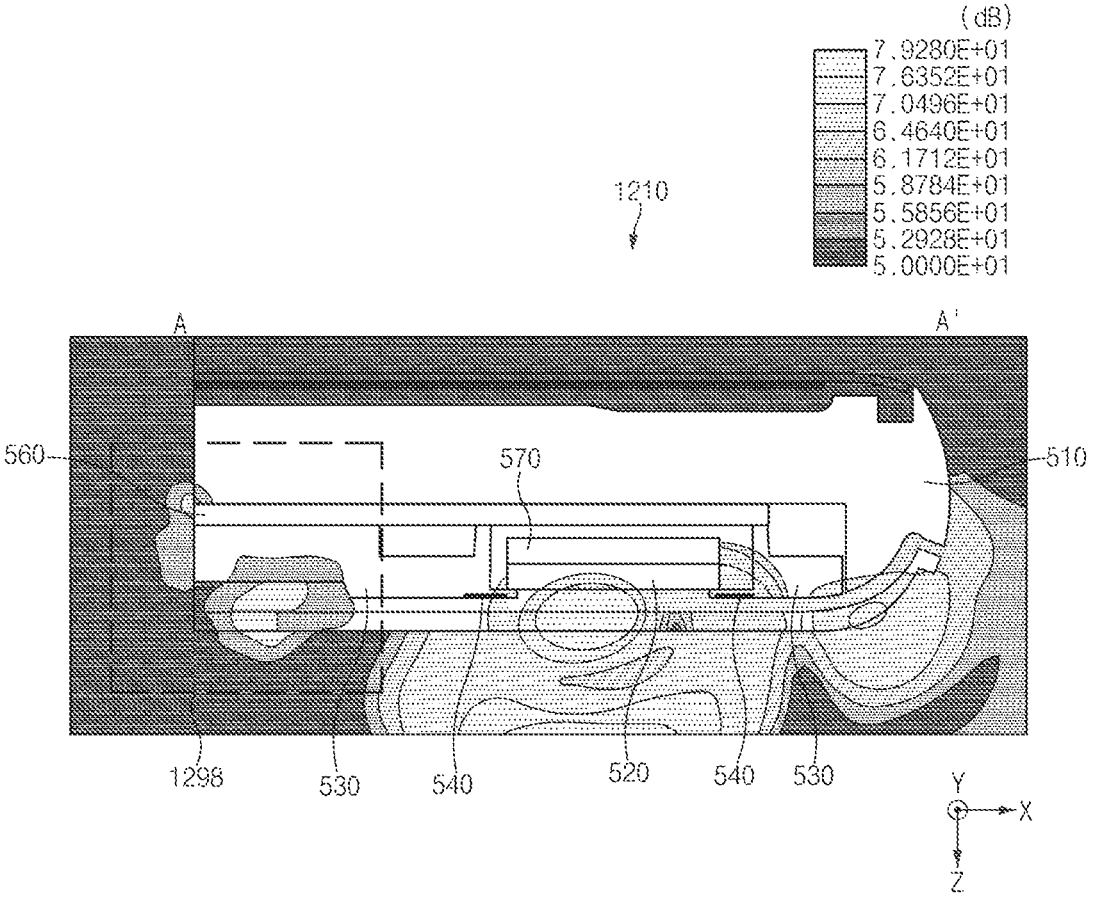
FIG. 12A is a diagram illustrating a signal radiated by an antenna module, according to an embodiment of the disclosure.
Figure 12B:
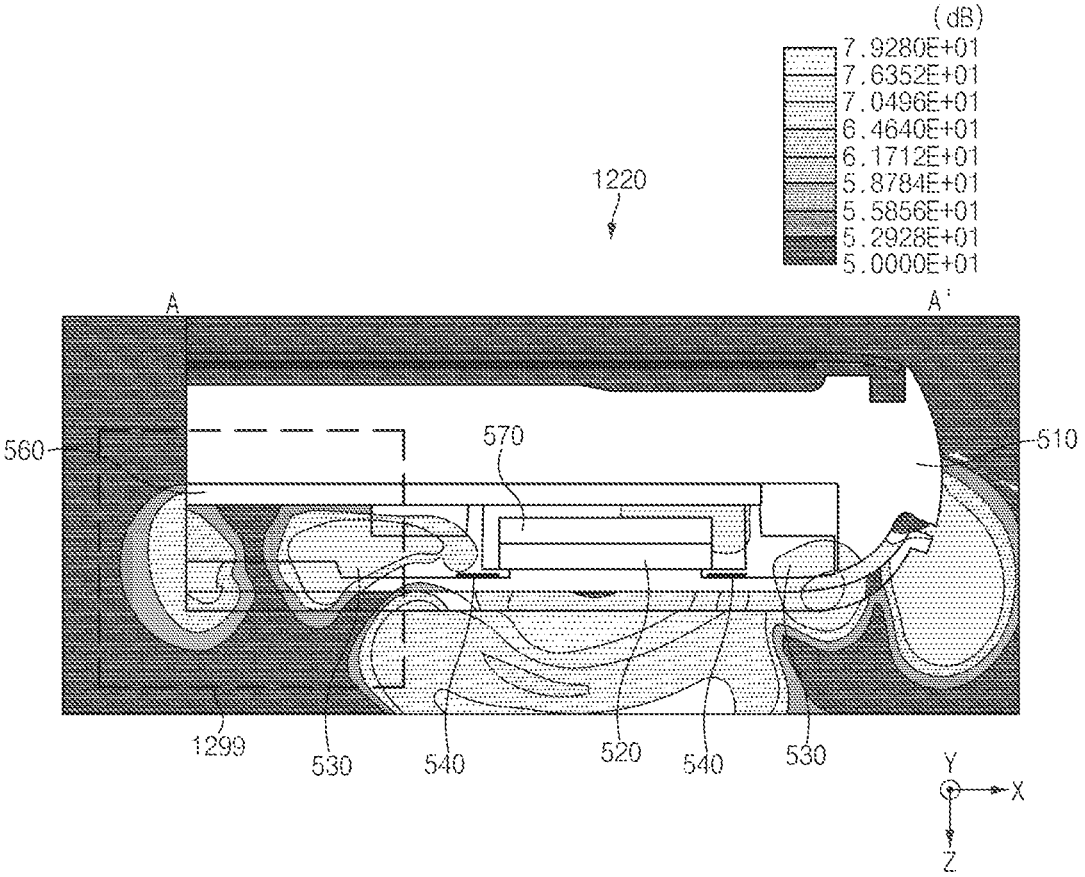
FIG. 12B is a diagram illustrating a signal radiated by an antenna module, according to another embodiment of the disclosure.

FIG. 12A is a diagram 1210 illustrating a signal radiated by an antenna module (e.g., the antenna module 520 of FIG. 5), according to an embodiment of the disclosure. FIG. 12B is a diagram 1220 illustrating a signal radiated by the antenna module 520, according to an embodiment of the disclosure.

The cross section in FIGS. 12A and 12B may correspond to the cross section of the electronic device taken along the line A-A' of FIG. 3A to the Z-axis. For example, the radiation pattern of FIG. 12A may correspond to the radiation pattern of a signal in a band of 28 GHz by the antenna module 520; the radiation pattern of FIG. 12B may correspond to the radiation pattern of a signal in a band of 39 GHz by the antenna module 520.

Referring to FIGS. 12A and 12B, the radiation pattern by the signal radiated by the antenna module 520 may be uniformly formed in the direction of the rear cover (e.g., the rear cover 710 of FIG. 7). The signal radiated around the antenna module 520 may be formed.

In an embodiment, it may be seen that undesired signals, which are radiated through the rear cover 710 and/or the injection-molding material 530, are substantially reduced. For example, when the surface wave propagating through the injection-molding material 530 reaches the rear cover (e.g., the rear cover 710 of FIG. 7) or the rear plate of the electronic device 101, the surface wave may be radiated, and thus the distortion may be generated in the radiation pattern of the antenna module 520. Referring to FIGS. 12A and 12B, as illustrated in a region 1298 of FIG. 12A and a region 1299 of FIG. 12B, the conductive pattern 540 may substantially prevent the distortion of the radiation pattern. In this case, it may be seen that the radiation pattern formed by the antenna module 520 has the improved E-field distribution.

In an embodiment, the surface wave propagating from the antenna module 520 to the injection-molding material 530 may be suppressed, and thus signal distortion may be reduced. Moreover, the distribution of the E-field formed by the antenna module 520 may be uniformly changed to reduce the distortion of the whole radiation pattern. Also, the null point generated in the −180 degrees direction which is the reference boresight of the electronic device (e.g., the electronic device 101 of FIG. 1) may be reduced, thereby easily performing beamforming.

Figure 13:
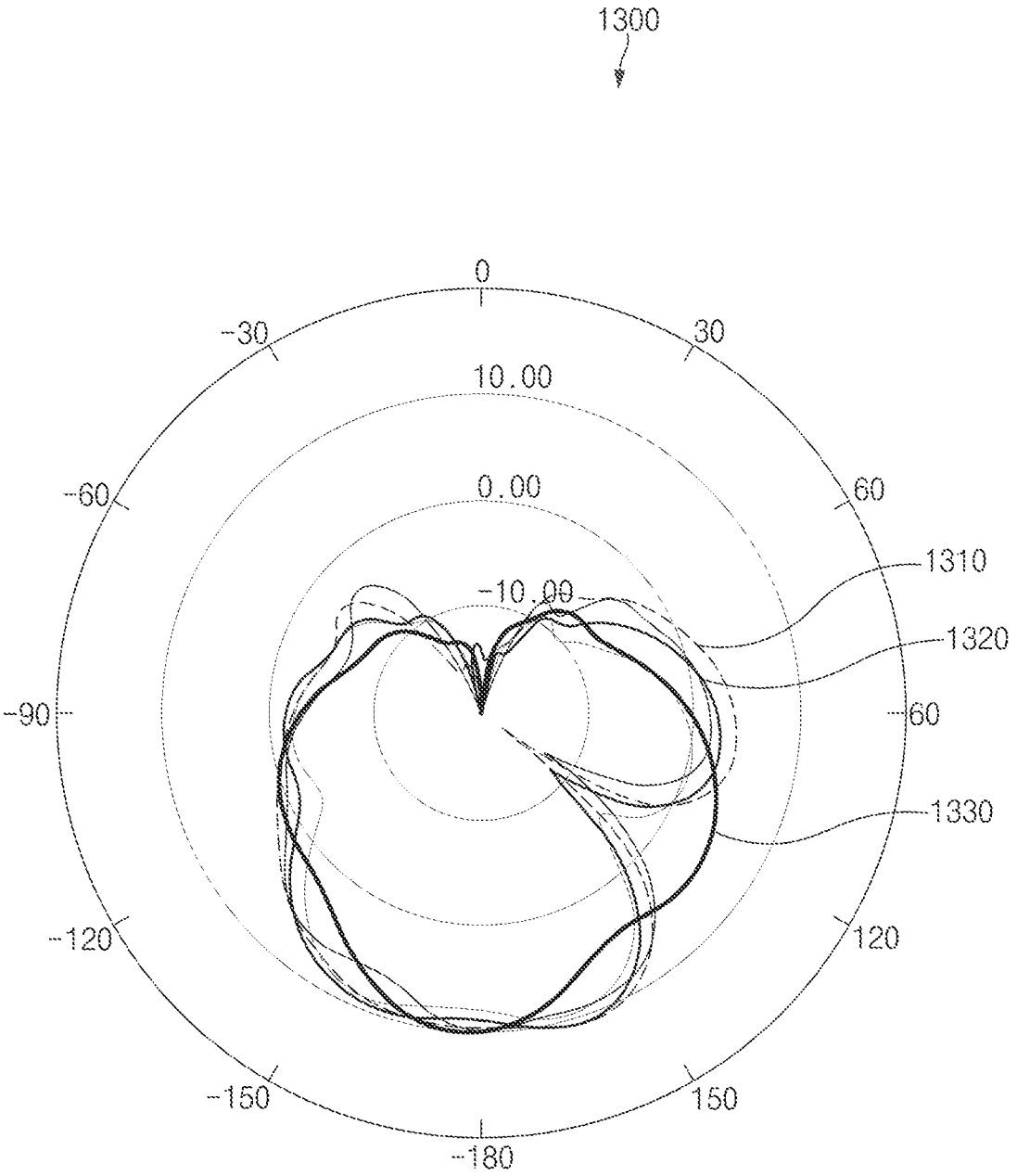
FIG. 13 is a diagram illustrating a signal radiated by an antenna module, according to an embodiment of the disclosure.

FIG. 13 is a diagram 1300 illustrating a signal radiated by an antenna module (e.g., the antenna module 520 of FIG. 5), according to an embodiment of the disclosure.

In an embodiment, a radiation pattern 1310 shown by a dotted line and a radiation pattern 1320 shown by a thin solid line may be radiation patterns when the conductive pattern 1020 is not present; a radiation pattern 1330 shown by a bold solid line may be a radiation pattern measured by an electronic device (e.g., the electronic device 101 of FIG. 1) according to an embodiment. As illustrated in FIG. 13, the distortion of the beam pattern may be reduced in the reference boresight (e.g., −180 degrees direction). The radiation pattern formed by the antenna module 520 may increase in the reference boresight and may decrease in the side direction. It may be seen that the side lobe of the radiation pattern formed by the antenna module 520 is reduced and the radiation pattern is flattened. Accordingly, the peak gain of the signal formed by the antenna module 520 may increase in the reference boresight.

Figure 14:
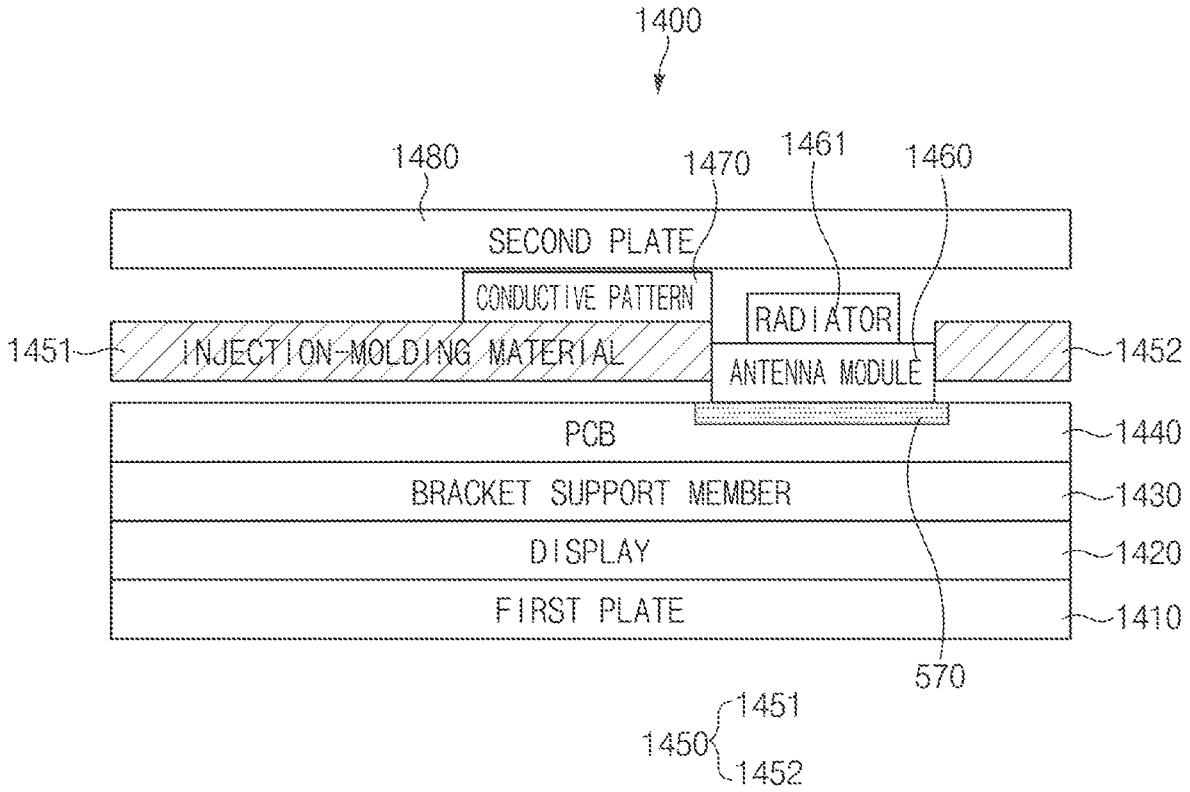
FIG. 14 is a diagram illustrating an electronic device, according to an embodiment of the disclosure.

FIG. 14 is a diagram illustrating an electronic device 1400 (e.g. the electronic device 101 of FIG. 1), according to an embodiment of the disclosure.

An electronic device 1400 according to an embodiment may include at least one of a first plate 1410, a display 1420 (e.g., the display device 160 of FIG. 1), a bracket support member 1430, a printed circuit board 1440 (e.g., the printed circuit board 560 of FIG. 11), an injection-molding material 1450 (e.g., the injection-molding material 530 of FIG. 11), an antenna module 1460 (e.g., the antenna module 520 of FIG. 11), the support member 570, a conductive pattern 1470 (e.g., the conductive pattern 1020 of FIG. 11), and a second plate 1480.

In an embodiment, the first plate 1410 may form the front surface of the electronic device 1400. The display 1420 may be exposed through at least part of the first plate 1410.

In an embodiment, the bracket support member 1430 may be disposed in a space between the display 1420 and the printed circuit board 1440. The bracket support member 1430 may support the printed circuit board 1440.

In an embodiment, the injection-molding material 1450 may be disposed in the space between the printed circuit board 1440 and the second plate 1480. The injection-molding material 1450 may include a first portion 1451 and/or a second portion 1452, which is formed to surround the antenna module 1460.

In an embodiment, the antenna module 1460 may be supported by the first portion 1451 of the injection-molding material 1450, the second portion 1452 of the injection-molding material 1450, and the support member 570. The support member 570 may be disposed between the PCB 1440 and the antenna module 1460. A radiator 1461 may be formed on one surface of the antenna module 1460.

In an embodiment, the conductive pattern 1470 may be disposed between the injection-molding material 1450 and the second plate 1480. The conductive pattern 1470 may be disposed adjacent to the antenna module 1460.

Figure 15:
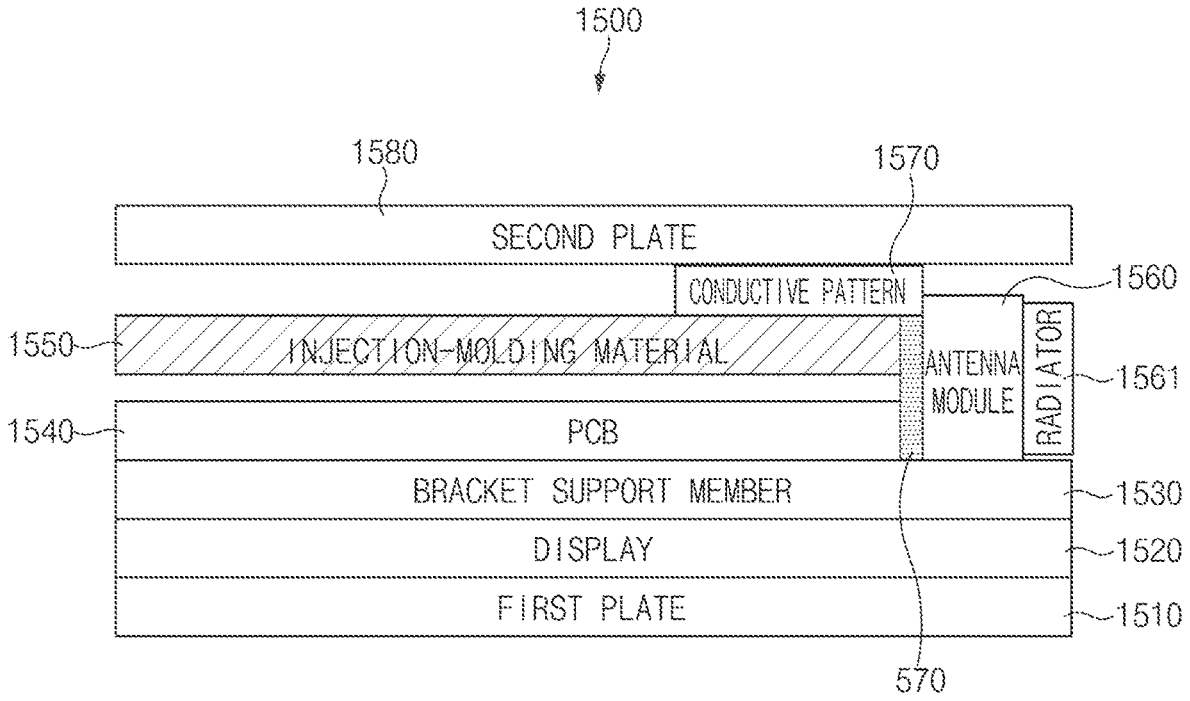
FIG. 15 is a diagram illustrating an electronic device, according to an embodiment of the disclosure.

FIG. 15 is a diagram illustrating an electronic device 1500 (e.g. the electronic device 101 of FIG. 1), according to an embodiment of the disclosure.

An electronic device 1500 according to an embodiment may include at least one of a first plate 1510, a display 1520 (e.g., the display device 160 of FIG. 1), a bracket support member 1530, a printed circuit board 1540 (e.g., the printed circuit board 560 of FIG. 11), an injection-molding material 1550 (e.g., the injection-molding material 530 of FIG. 11), an antenna module 1560 (e.g., the antenna module 520 of FIG. 11), the support member 570, a conductive pattern 1570 (e.g., the conductive pattern 1020 of FIG. 11), and a second plate 1580. The first plate 1510, the display 1520, the bracket support member 1530, the printed circuit board 1540, and the second plate 1480 of FIG. 15 are substantially the same components as the first plate 1410, the display 1420, the bracket support member 1430, the printed circuit board 1440, the injection-molding material 1450, and the second plate 1480 of FIG. 14, and thus the description thereof is omitted.

In an embodiment, the antenna module 1560 may be disposed above the bracket support member 1530. The antenna module 1560 may be disposed on one side surface of the printed circuit board 1540 and the injection-molding material 1550. The antenna module 1560 may be supported by the injection-molding material 1550 and the support member 570. The support member 570 may be disposed between one side of the antenna module 1560 and one side of each of the PCB 1540 and the injection-molding material 1550. The antenna module 1560 may be mounted such that the beam pattern is formed to be substantially parallel to the second plate 1580 by the radiator 1561. For example, the antenna module 1560 may be disposed substantially perpendicular to the second plate 1580.

In an embodiment, the conductive pattern 1570 may be disposed on the injection-molding material 1550. The conductive pattern 1570 may be disposed adjacent to the antenna module 1560.

An electronic device (e.g., the electronic device 101 of FIG. 1) according to various embodiments may include a housing (e.g., the housing 510 of FIG. 5) including a first plate (e.g., the first plate 1410 of FIG. 14), a second plate (e.g., the second plate 1480 of FIG. 14) facing away from the first plate 1410, and a side member surrounding a space between the first plate 1410 and the second plate 1480, connected to the second plate 1480 or integrally formed with the second plate 1480, and including a conductive material, an injection-molding material (e.g., the injection-molding material 530 of FIG. 5) disposed in the space between the first plate 1410 and the second plate 1480 in the housing 510 and formed of a non-conductive material, an antenna module (e.g., the antenna module 520 of FIG. 5) supported by the injection-molding material 530, and a conductive pattern (e.g., the conductive pattern 540 of FIG. 5) disposed on the injection-molding material 530 and disposed adjacent to at least part of an edge of the antenna module 520. For example, the antenna module may include a plurality of conductive radiators (e.g., the dipole antennas 525, 526, 527, and 528 and the patch antennas 521, 522, 523, and 524 of FIG. 5); at least a partial conductive radiator among the plurality of conductive radiators may be disposed to transmit and/or receive a signal through the second plate 1480. For example, the conductive pattern may be disposed on a first surface adjacent to the second plate 1480 of the injection-molding material 530 or disposed inside the injection-molding material 530 and may be disposed adjacent to at least part of an edge of the antenna module 520 corresponding to a boundary between the antenna module 520 and the injection-molding material 530 when viewed from the second plate 1480 in the direction of the first plate 1410.

In an embodiment, the conductive pattern 540 may be disposed on the first surface to surround at least part of an edge of the antenna module 520 when viewed from the second plate 1480 in the direction of the first plate 1410. For example, the conductive pattern 540 may be disposed on the first surface to surround an edge of the antenna module 520 when viewed from the second plate 1480 in the direction of the first plate 1410. For another example, at least part of the plurality of conductive radiators 521, 522, 523, 524, 525, 526, 527, and 528 may form the dipole antennas 525, 526, 527, and 528; when viewed from the second plate 1480 in the direction of the first plate 1410, the conductive pattern 540 may be disposed on the first surface to be adjacent to at least part of the remaining regions other than a region, where the dipole antennas 525, 526, 527, and 528 are disposed, in the edge of the antenna module 520 when viewed from the second plate in the first plate direction.

In an embodiment, the conductive pattern 540 may include a plurality of sub patterns (e.g., the first to seventh sub patterns 611, 612, 613, 614, 615, 616, and 617 of FIG. 6) disposed adjacent to the edge of the antenna module, and each of the plurality of the first to seventh sub patterns 611, 612, 613, 614, 615, 616, and 617 may be spaced from one another.

In an embodiment, when viewed from the second plate 1480 in the direction of the first plate 1410, the plurality of sub patterns 611, 612, 613, 614, 615, 616, and 617 are disposed in only a region on the first surface extending in a second direction (e.g., +Y direction) from a first straight line (e.g., the first straight line A1 of FIG. 6) on the first surface. For example, the first straight line may be a virtual straight line extending from an edge adjacent to the plurality of dipole antennas 525, 526, 527, and 528 of the antenna module; the second direction is perpendicular to the first straight line A1 on the first surface and is opposite to a first direction (e.g., −Y direction). For example, the first direction may be a direction away from the antenna module 520 from an edge adjacent to the plurality of dipole antennas 525, 526, 527, and 528.

According to an embodiment, at least part of the plurality of sub patterns 611, 612, 613, 614, 615, 616, 617 may be configured to transmit and/or receive a frequency signal (e.g., about less than 6 GHz) in a second band different from the plurality of conductive radiators 521 to 528 of the antenna module 520. For example, the plurality of conductive radiators 521 to 528 of the antenna module 520 may be configured to transmit and/or receive a frequency signal (e.g., a signal of 6 GHz or more) in a first band. For example, the lower limit of the first band may be higher than the upper limit of the second band.

In an embodiment, the electronic device may further include a camera (e.g., the camera 550 of FIG. 5) disposed adjacent to the conductive pattern 540 and a conductive camera support member (e.g., the camera deco 554) disposed to support the camera 550 and to surround an edge of the camera 550. The camera support member 554 may be at least part of the conductive pattern 540.

An electronic device (e.g., the electronic device 101 of FIG. 1) according to various embodiments may include the housing 510 including the first plate 1410, the second plate 1480 facing away from the first plate 1410, and a side member surrounding a space between the first plate 1410 and the second plate 1480, connected to the second plate 1480 or integrally formed with the second plate 1480, and including a conductive material, the injection-molding material 530 disposed in the space between the first plate 1410 and the second plate 1480 in the housing 510 and formed of a non-conductive material, the antenna module 520 supported by the injection-molding material 530, and a plurality of conductive patterns (e.g., the first to fifth conductive patterns 821, 822, 823, 824, and 825 of FIG. 8) disposed on the injection-molding material 530. For example, the antenna module may include a plurality of conductive radiators (e.g., the dipole antennas 525, 526, 527, and 528 and the patch antennas 521, 522, 523, and 524 of FIG. 5); at least a partial conductive radiator among the plurality of conductive radiators may be disposed to transmit or receive a signal through the second plate 1480. For example, the conductive pattern 540 may be disposed on a first surface adjacent to the second plate 1480 of the injection-molding material 530 or disposed inside the injection-molding material 530 and may be disposed adjacent to at least part of an edge of the antenna module 520 corresponding to a boundary between the antenna module 520 and the injection-molding material 530 when viewed from the second plate 1480 in the direction of the first plate 1410. The plurality of conductive patterns 821, 822, 823, 824, and 825 may include at least one first conductive pattern configured to transmit or receive a signal of less than 6 GHz and may be disposed spaced from one another.

In an embodiment, the electronic device 101 may further include a protrusion portion (e.g., the protrusion portion 810 of FIG. 8) surrounding an edge of the antenna module 520, protruding from a first surface in the direction of the second plate 1480, and formed of a non-conductive material. For example, the protrusion portion 810 may be the same material as the injection-molding material 530. For another example, the protrusion portion 810 may further protrude in a first vertical direction (e.g., +Z axis direction of FIG. 7) than the antenna module 520. For still another example, the protrusion portion 810 may further protrude in the second plate direction on the first surface than the antenna module 520.

According to an embodiment, the plurality of conductive patterns 821, 822, 823, 824, 825 may be at least partially disposed adjacent to the protrusion portion 810 and may further include at least one second conductive pattern 822, 823 for blocking at least part of a signal radiated using at least part of the plurality of radiators in the antenna module from being transmitted to the injection-molding material 530. For example, the at least one second conductive pattern may include at least one third conductive pattern 832 overlapping with at least part of the protrusion portion 830 on the first surface. For example, the plurality of conductive patterns 821, 822, 823, 824, 825 may be engraved or plated on the first surface of the injection-molding material 530.

According to an embodiment, the electronic device 101 may further include a communication circuit (e.g., the communication module 190 of FIG. 1). For example, the at least one the first conductive pattern 821 may be electrically connected to the communication circuit 190 through at least one via or C-clip; the at least one second conductive pattern 822 and 823 may be electrically connected to a ground layer (e.g., the ground layer 433 of FIG. 4) through at least one via or C-clip.

In an embodiment, at least part of a plurality of conductive patterns 821, 822, 823, 824, and 825 may be at least one the first conductive pattern 821 used as a legacy antenna that performs wireless communication in addition to 5G. For example, a plurality of conductive radiators of the antenna module 520 may be configured to transmit or receive a signal of 6 GHz or more.

According to an embodiment, the antenna module 520 may include a wireless communication circuit (e.g., the third RFIC 226 of FIG. 4) positioned on a third surface, on which patch antenna elements (521 to 524 of FIG. 5) are disposed, among the plurality of radiator and positioned on a surface opposite to the third surface. For example, the antenna module 520 may be disposed such that the second plate and the third surface are substantially horizontal in the housing. For another example, the antenna module 520 may be disposed such that the second plate and the third surface are substantially perpendicular to each other in the housing.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

According to embodiments disclosed in the specification, it is possible to prevent the surface wave from being transmitted to the injection-molding material by the conductive pattern disposed around the antenna module and to prevent the multiple reflection from occurring using the conductive pattern. As such, it is possible to prevent the distortion of the signal radiated by the antenna module and to increase the gain of the signal radiated by the antenna module to the outside of the electronic device.

Besides, a variety of effects directly or indirectly understood through the disclosure may be provided.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A portable communication device comprising:

a first printed circuit board (PCB);

a non-conductive member including a conductive portion formed in one or more regions of the non-conductive member; and an antenna module, wherein the antenna module includes:

a second PCB including a first peripheral portion, a second peripheral portion, a third peripheral portion, and a fourth peripheral portion, and an antenna array including a plurality of antenna elements disposed along a first direction, wherein the first peripheral portion is parallel to the first direction, and wherein the conductive portion is formed adjacent to at least part of the second peripheral portion, and at least one peripheral portion among the third peripheral portion and the fourth peripheral portion.

2. The portable communication device of claim 1, wherein the second PCB includes a conductive material and a first non-conductive material, and wherein the non-conductive member includes a second non-conductive material different from the first non-conductive material.

3. The portable communication device of claim 2, wherein the first PCB includes the conductive material and a third non-conductive material, and wherein the non-conductive member includes the second non-conductive material different from the third non-conductive material.

4. The portable communication device of claim 1, wherein the second PCB is smaller than the first PCB.

5. The portable communication device of claim 1, wherein at least a part of the conductive portion is parallel to the second peripheral portion.

6. The portable communication device of claim 1, wherein the third peripheral portion extending between a first end of the first peripheral portion and a first end of the second peripheral portion, wherein the fourth peripheral portion extending between a second end of the first peripheral portion and a second end of the second peripheral portion, and wherein at least a part of the conductive portion is disposed to surround at least part of the second peripheral portion, at least a part of the third peripheral portion, and at least a part of the fourth peripheral portion.

7. The portable communication device of claim 1, wherein a length of the conductive portion is longer than a length of the first peripheral portion.

8. The portable communication device of claim 1, further comprising:

a housing accommodating the antenna module, wherein the housing includes a first plate and a second plate facing away from the first plate, and wherein the non-conductive member is at least a part of the second plate.

9. The portable communication device of claim 1, wherein the antenna array is configured to transmit or receive a signal in a first frequency band, and wherein the conductive portion is coupled with the antenna array to be configured to transmit or receive a signal in the first frequency band.

10. The portable communication device of claim 1, wherein the antenna array includes a plurality of patch antennas.

* * * * *